US010905300B2

(12) United States Patent
Lee et al.

(10) Patent No.: US 10,905,300 B2
(45) Date of Patent: Feb. 2, 2021

(54) VACUUM CLEANER AND METHOD OF CONTROLLING THE SAME

(71) Applicant: Samsung Electronics Co., Ltd, Suwon-si (KR)

(72) Inventors: Seon Gu Lee, Yongin-si (KR); Gi Hyeong Lee, Suwon-si (KR); Jae Shik Jeong, Suwon-si (KR); Yoon Kyunh Cho, Suwon-si (KR); Ah Young Lee, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 283 days.

(21) Appl. No.: 16/073,221

(22) PCT Filed: Jan. 25, 2017

(86) PCT No.: PCT/KR2017/000885
§ 371 (c)(1),
(2) Date: Jul. 26, 2018

(87) PCT Pub. No.: WO2017/131436
PCT Pub. Date: Aug. 3, 2017

(65) Prior Publication Data

US 2019/0038100 A1 Feb. 7, 2019

(30) Foreign Application Priority Data

Jan. 27, 2016 (KR) ..... 10-2016-0009862

(51) Int. Cl.
*A47L 9/28* (2006.01)
*A47L 5/14* (2006.01)
(Continued)

(52) U.S. Cl.
CPC ..... *A47L 9/2878* (2013.01); *A47L 5/14* (2013.01); *A47L 5/225* (2013.01); *A47L 5/26* (2013.01)

(58) Field of Classification Search
CPC ..... A47L 9/2878; A47L 5/225; A47L 5/26; A47L 5/14; A47L 5/00; A47L 7/00;
(Continued)

(56) References Cited

U.S. PATENT DOCUMENTS 4,835,409 A * 5/1989 Bhagwat ..... A47L 9/2805 307/64
6,448,732 B1 * 9/2002 Block ..... H02J 7/0003 318/635
(Continued)

FOREIGN PATENT DOCUMENTS

JP 2014-045538 A 3/2014
KR 10-2012-0003661 A 1/2012
(Continued)

OTHER PUBLICATIONS

International Search Report dated May 4, 2017 in connection with International Patent Application No. PCT/KR2017/000885.
(Continued)

*Primary Examiner* — Antony M Paul

(57) ABSTRACT

A vacuum cleaner includes a fan motor configured to generate suction, an input button configured to receive an input of a user, a first power supply circuit configured to convert alternating current (AC) power supplied from an external power source and output first direct current (DC) power, a second power supply circuit configured to store electric energy upon receiving the first DC power, and output second DC power based on the stored electric energy, a driver circuit configured to drive the fan motor upon receiving at least one of the first DC power and the second DC power, a first semiconductor switching circuit config-
(Continued)

ured to control the first DC power supplied to the second power supply circuit, a second semiconductor switching circuit configured to control the first DC power and the second DC power that are supplied to the driver circuit, and a microprocessor configured to output a control signal for turning on or off the first semiconductor switching circuit and the second semiconductor switching circuit depending on the user input and a connection state of the external power source.

15 Claims, 15 Drawing Sheets

(51) Int. Cl.
*A47L 5/22* (2006.01)
*A47L 5/26* (2006.01)

(58) Field of Classification Search
CPC . A47L 9/00; A47L 11/00; A47L 13/00; H02P 1/265; H02P 1/28; H02P 1/42; H02P 1/465; H02P 3/00; H02P 3/08; H02P 3/24; H02P 6/00; H02P 6/14; H02P 7/00; H02P 7/025; H02P 7/06; H02P 7/05; H02P 7/29; H02P 7/295; H02P 8/04; H02P 11/00; H02P 11/04; H02P 21/00; H02P 23/00; H02P 25/00; H02P 27/00; H02P 27/04; H02P 27/06; H02P 2201/03; H02P 1/00; H02P 1/18; H02P 1/12; H02P 1/16; H02P 1/26
USPC ..... 318/400.01, 700, 701, 727, 799, 800
See application file for complete search history.

(56) References Cited

U.S. PATENT DOCUMENTS

| | | | | |
|---|---|---|---|---|
| 7,712,182 | B2 * | 5/2010 | Zeiler | A47L 5/14 15/319 |
| 7,898,209 | B2 * | 3/2011 | Kim | A47L 9/2805 318/139 |
| 7,932,688 | B2 * | 4/2011 | Han | A47L 9/2878 318/441 |
| 8,732,896 | B2 * | 5/2014 | Lucas | A01D 34/78 15/319 |
| 8,810,067 | B2 | 8/2014 | Kim et al. | |
| 8,923,722 | B2 | 12/2014 | Choi et al. | |
| 2014/0056738 | A1 * | 2/2014 | Takahashi | A47L 9/2857 417/411 |

FOREIGN PATENT DOCUMENTS

| | | | |
|---|---|---|---|
| KR | 10-2012-0011237 | A | 2/2012 |
| KR | 10-2012-0107611 | A | 10/2012 |
| KR | 10-2015-0006737 | A | 1/2015 |

OTHER PUBLICATIONS

Whitten Opinion of the International Searching Authority dated May 4, 2017 in connection with International Patent Application No. PCT/KR2017/000885.

* cited by examiner

【Fig. 1a】
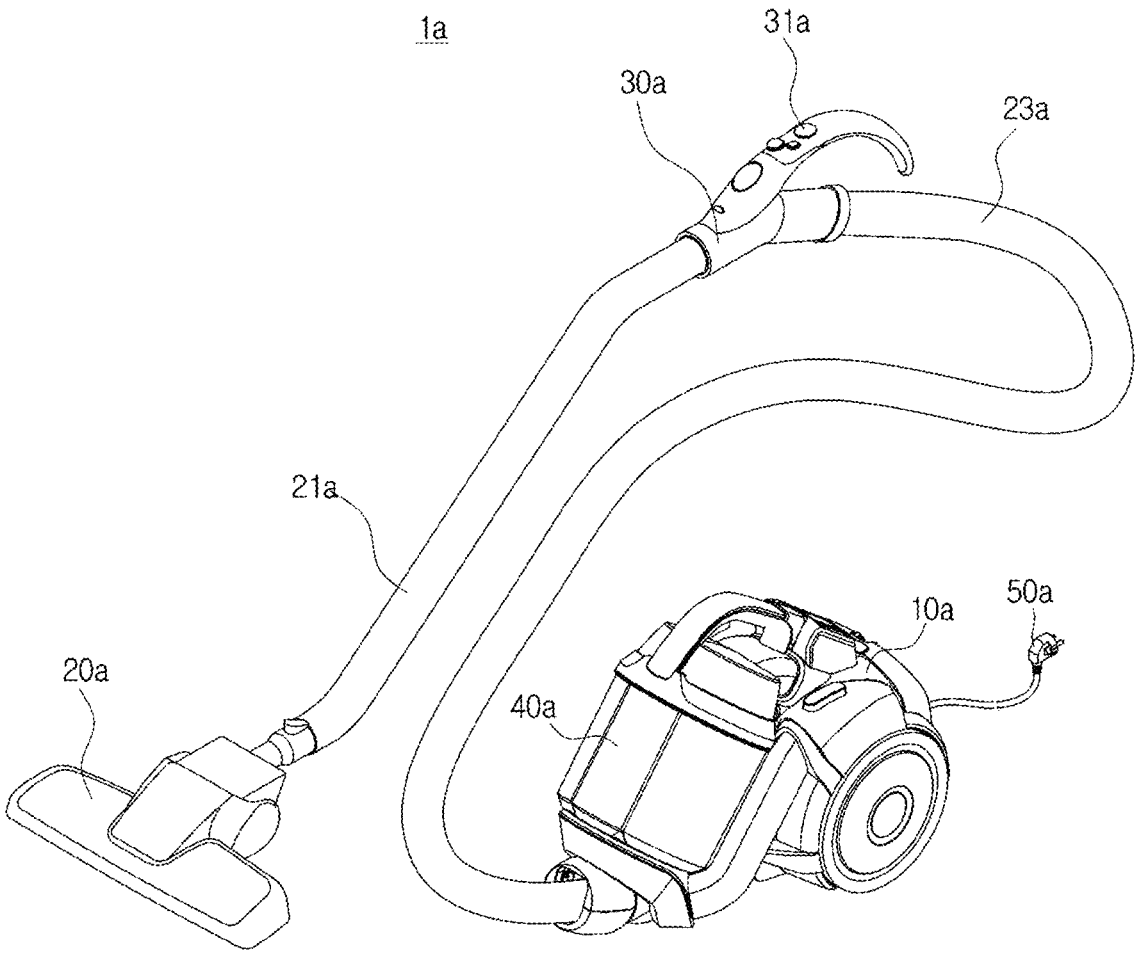

【Fig. 1b】
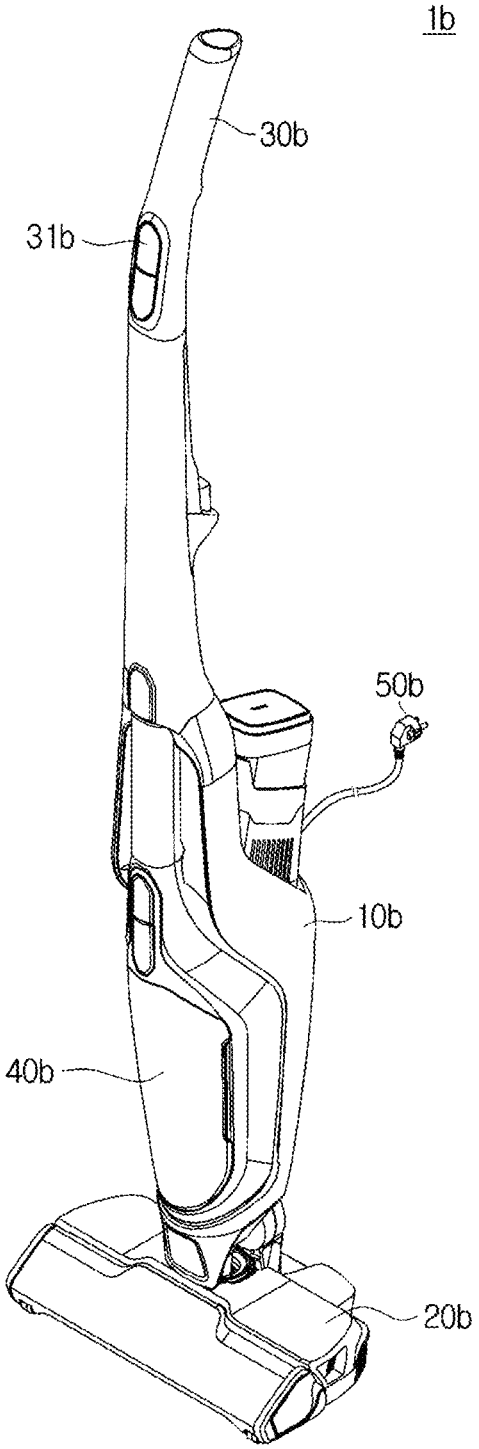

【Fig. 2】
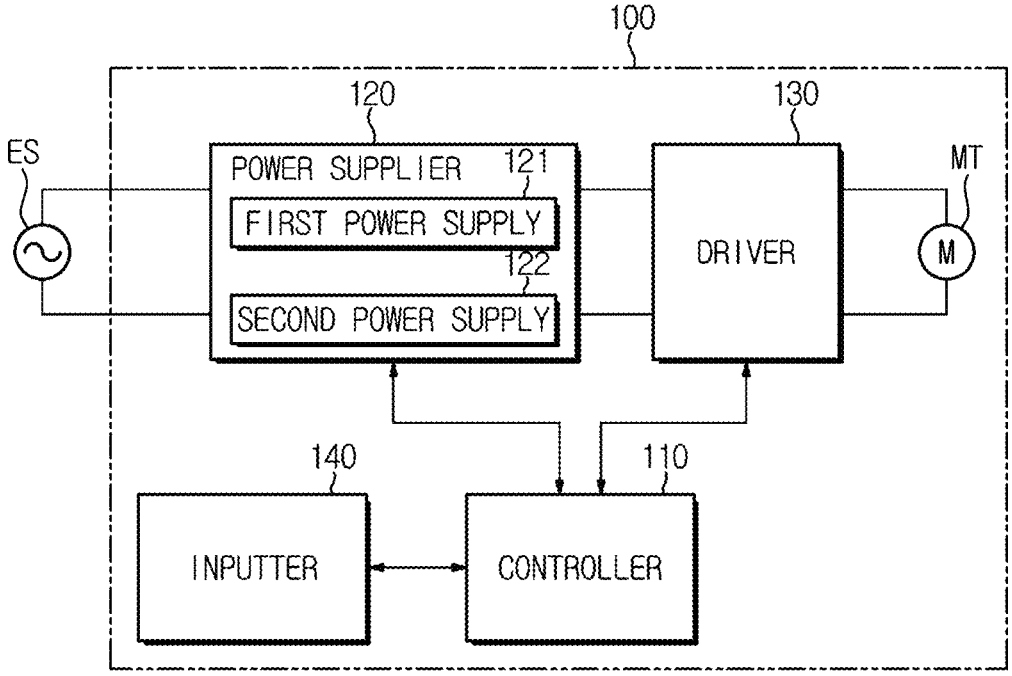

【Fig. 3】
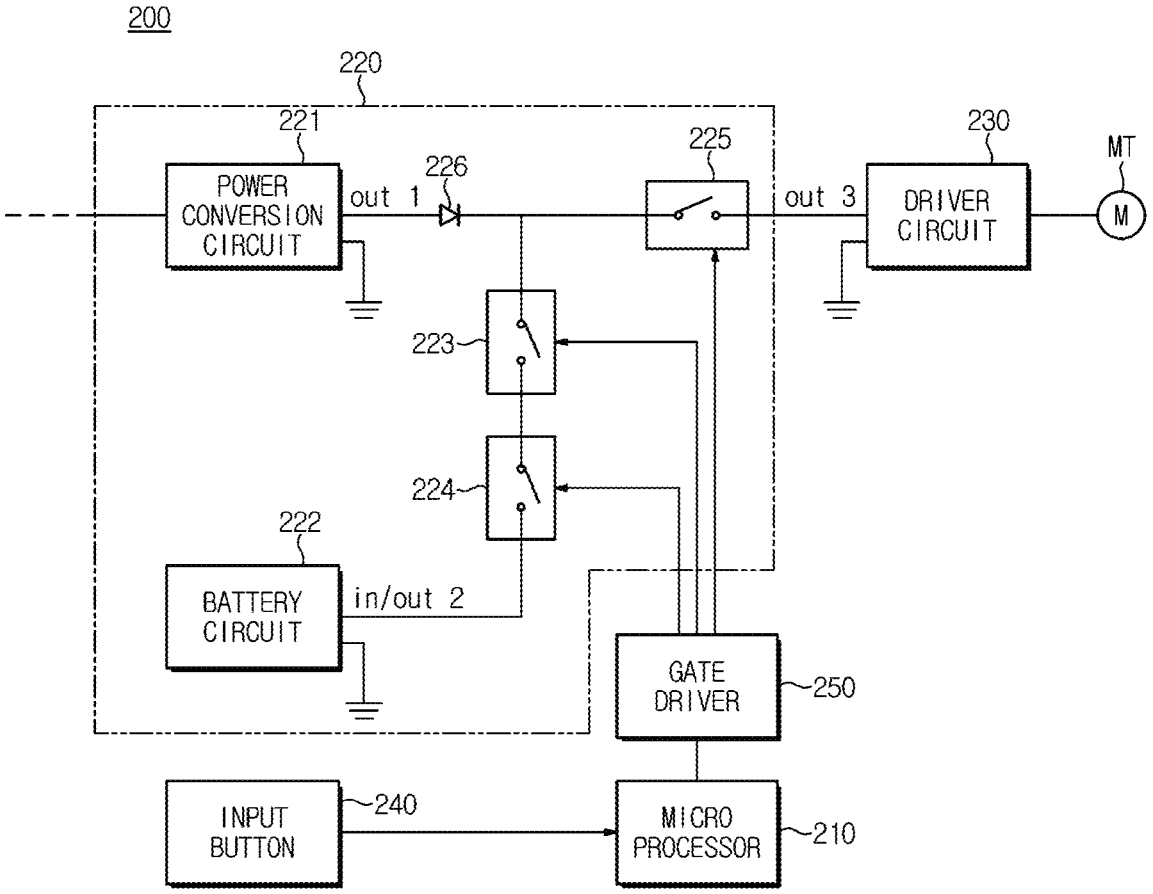

【Fig. 4】
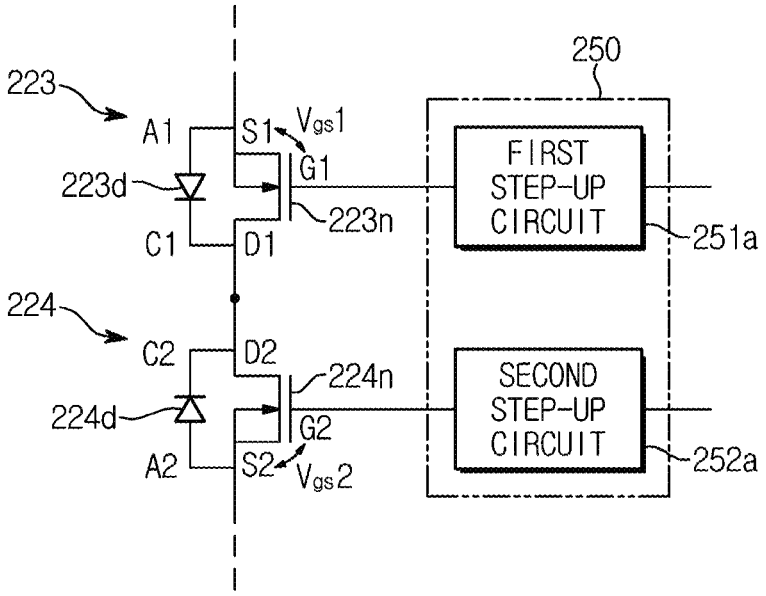

【Fig. 5】
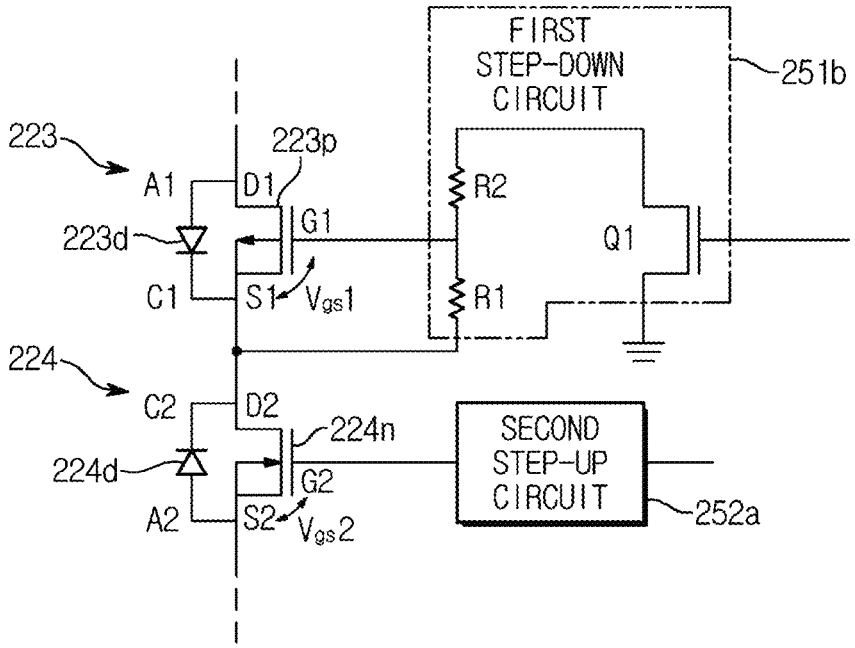

【Fig. 6】
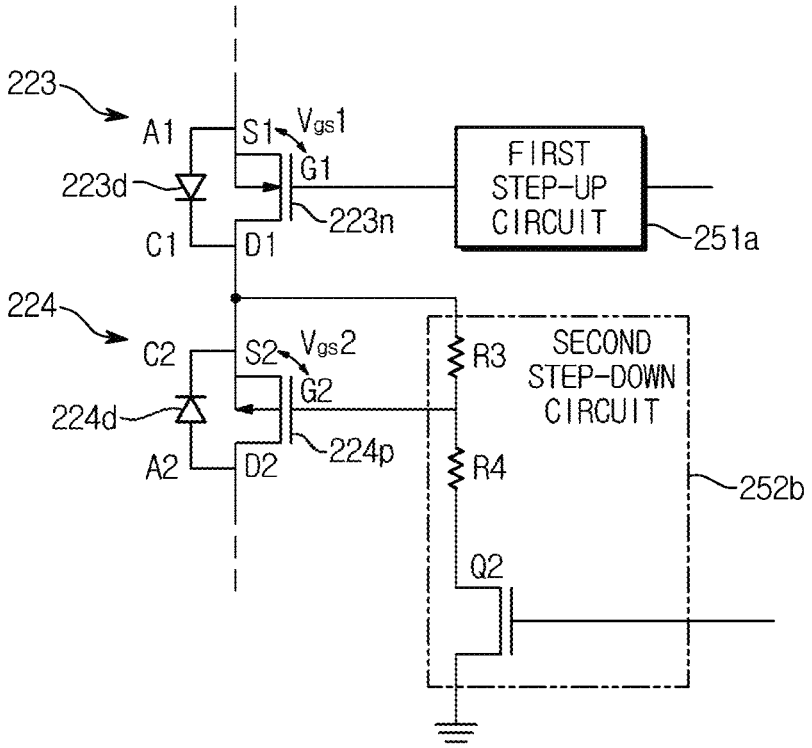

【Fig. 7】
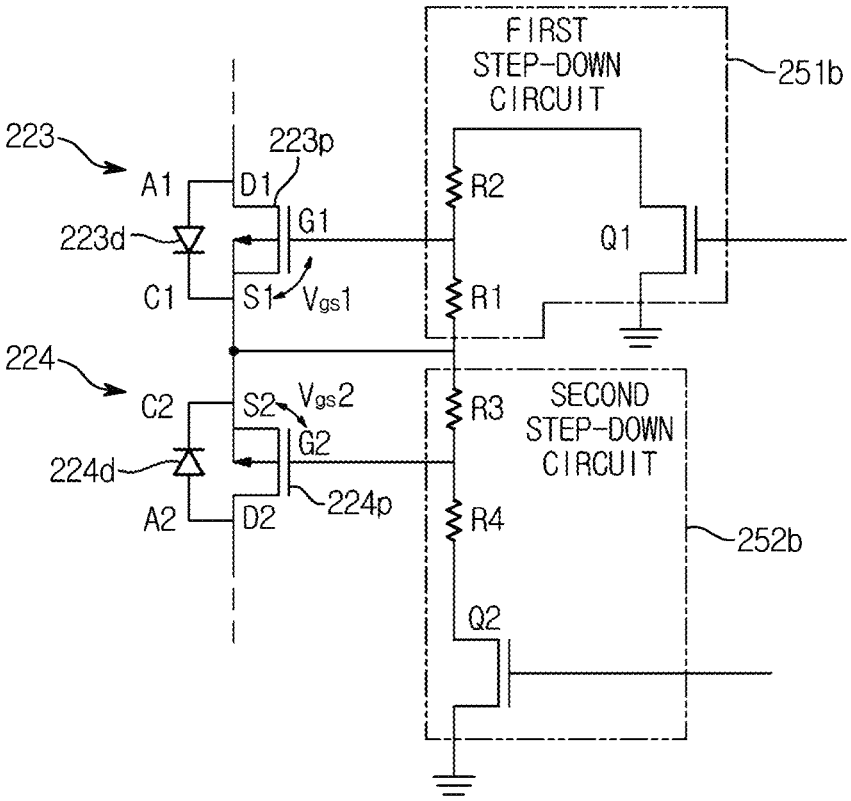

[Fig. 8]
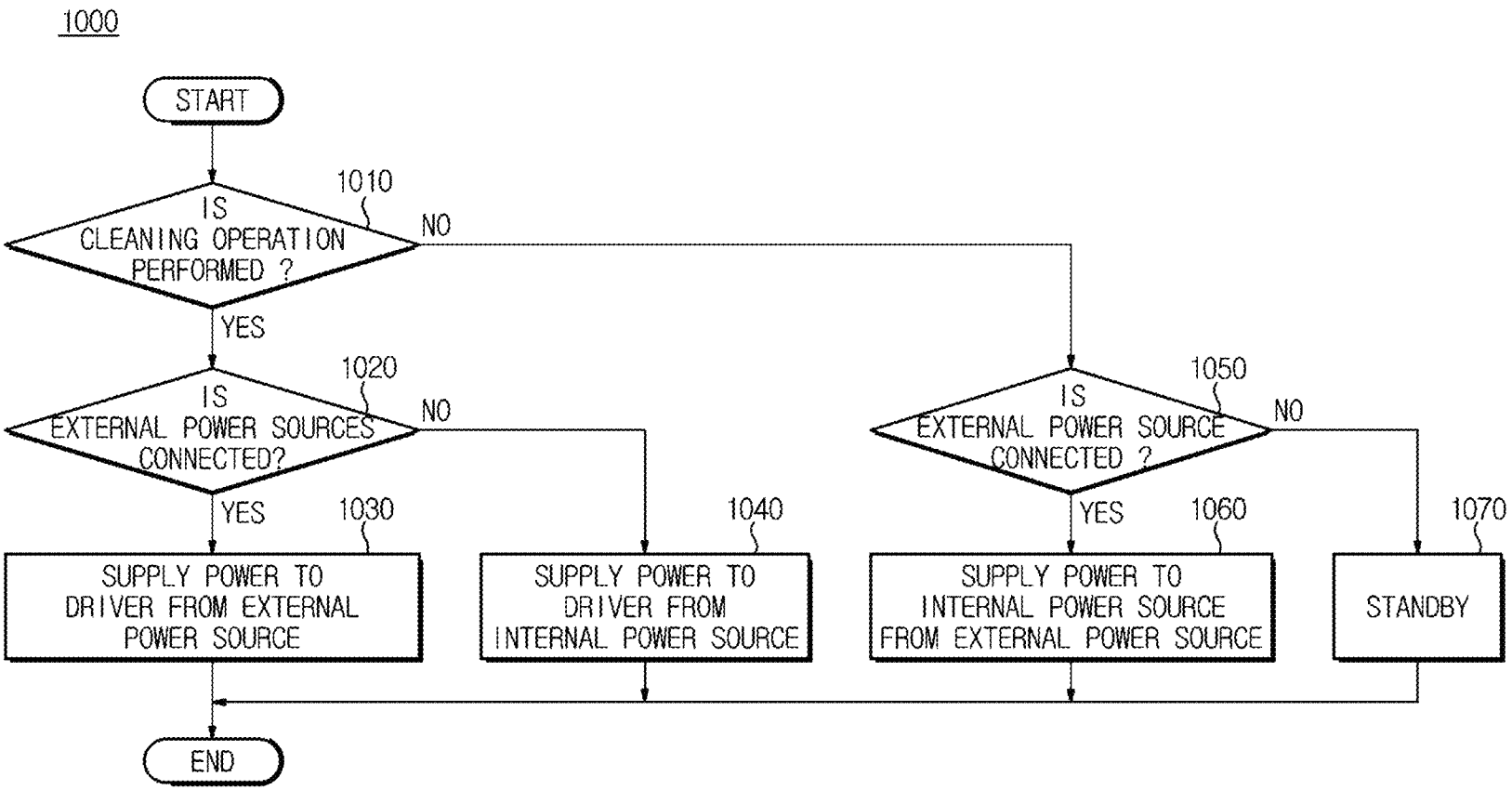

【Fig. 9】
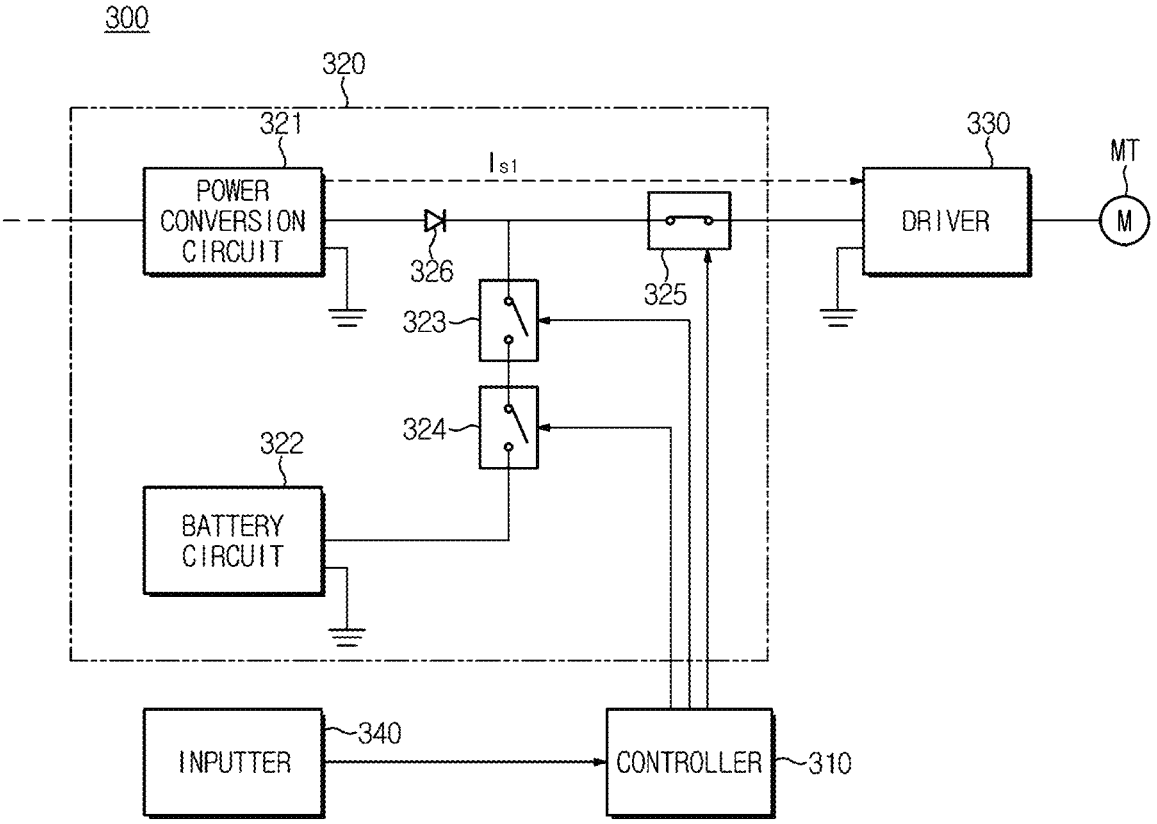

【Fig. 10】
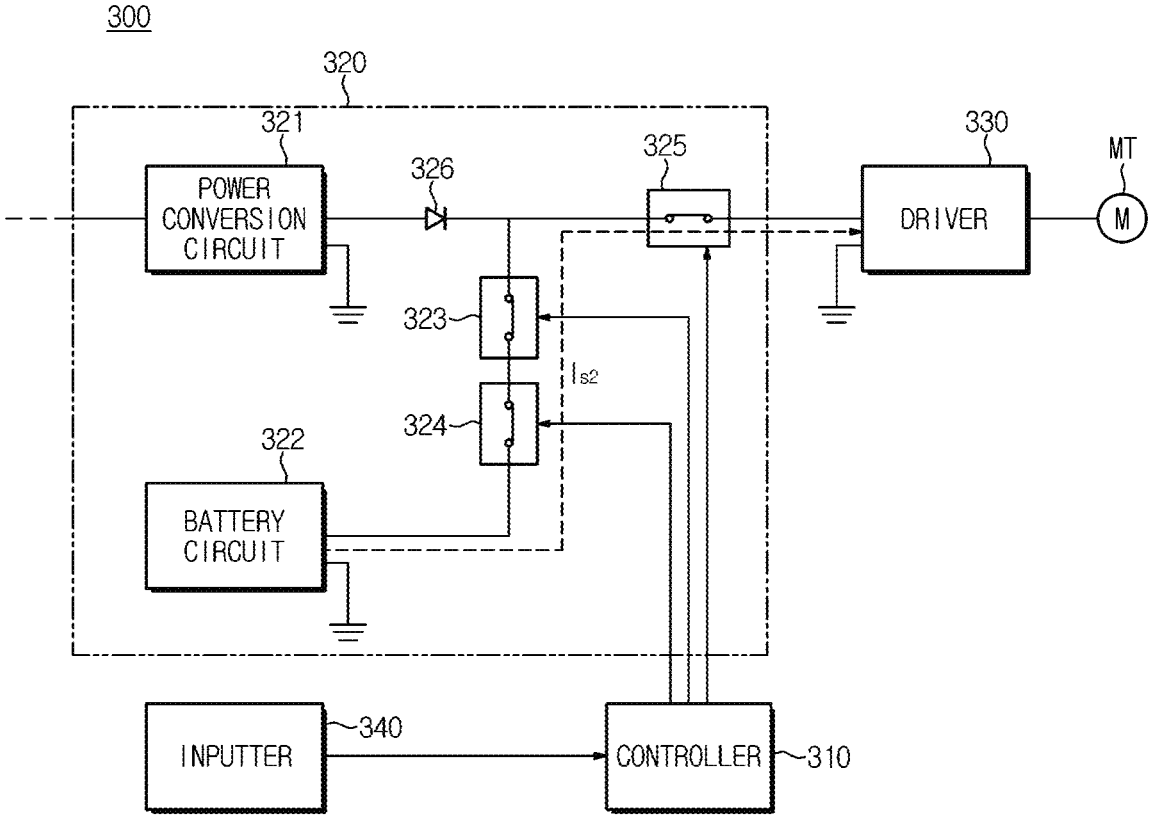

【Fig. 11】
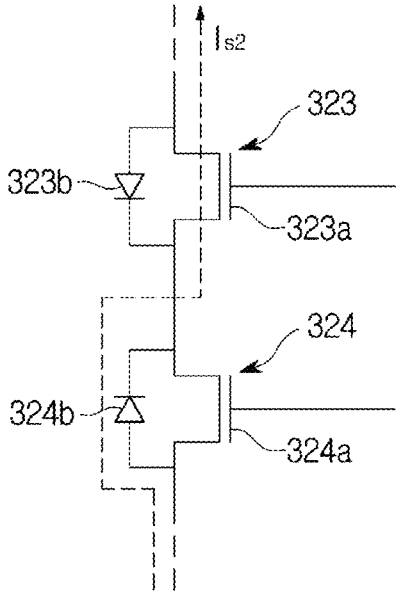

【Fig. 12】
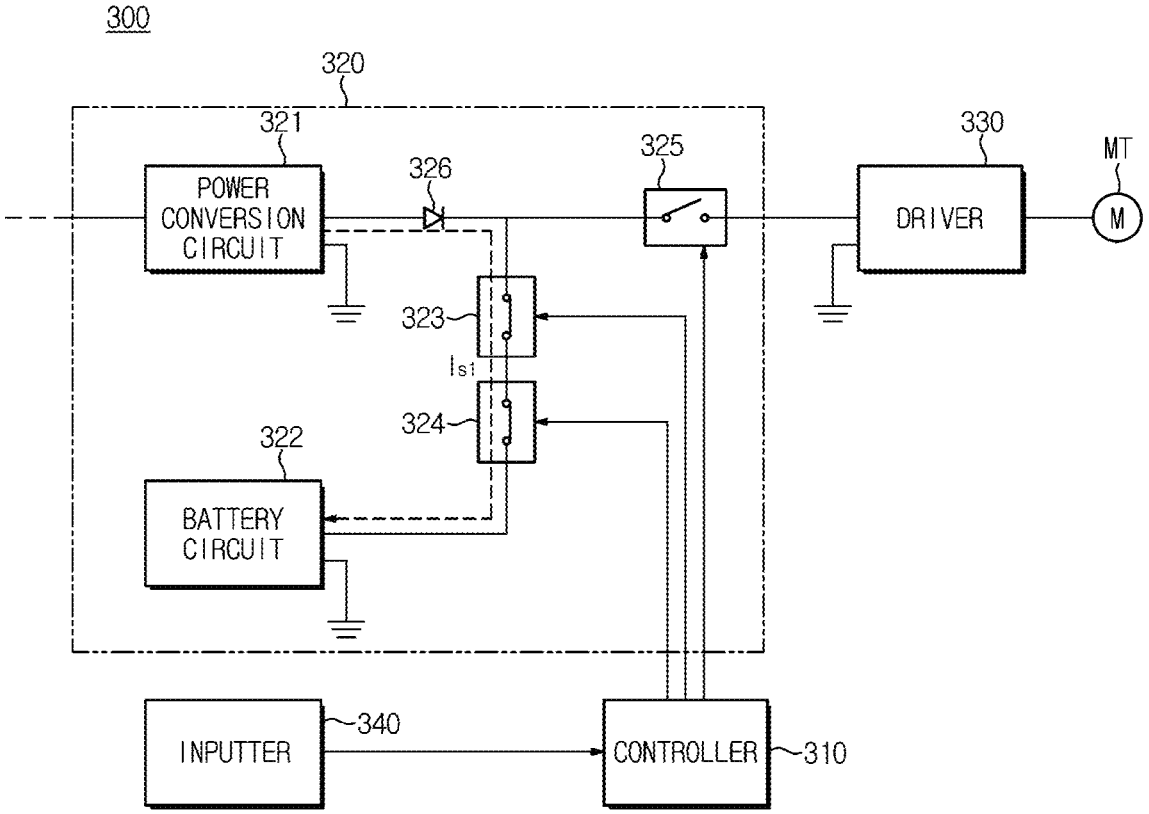

【Fig. 13】
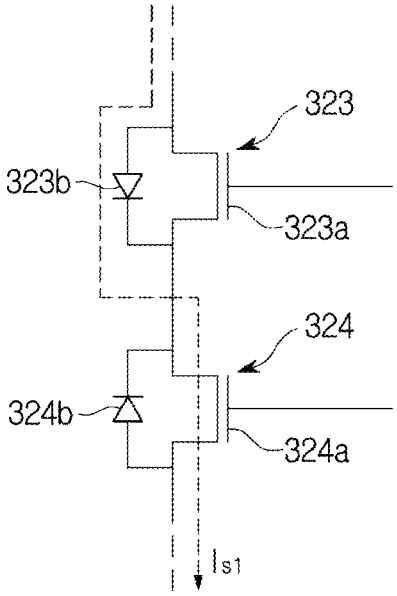

【Fig. 14】
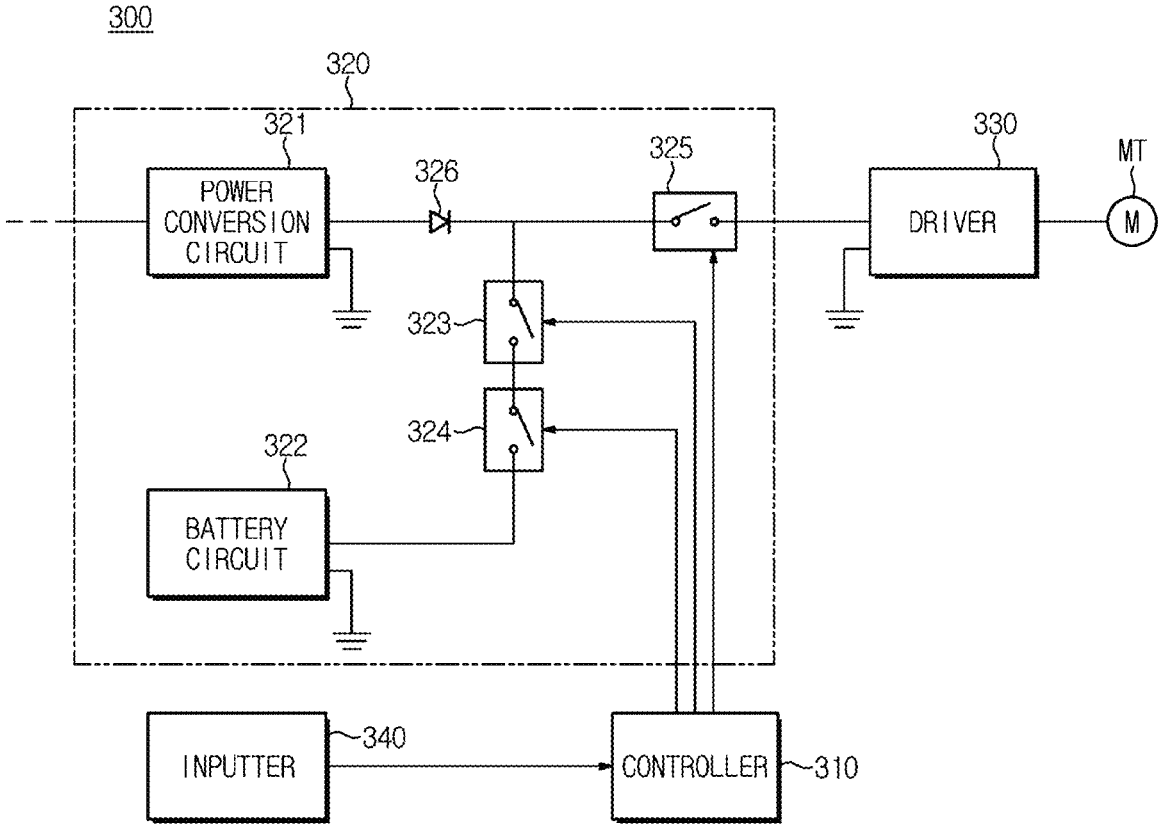

VACUUM CLEANER AND METHOD OF CONTROLLING THE SAME

CROSS-REFERENCE TO RELATED APPLICATIONS AND CLAIM OF PRIORITY

This application is a 371 of International Application No. PCT/KR2017/000885 filed Jan. 25, 2017, which claims priority to Korean Patent Application No. 10-2016-0009862 filed Jan. 27, 2016, the disclosures of which are herein incorporated by reference in their entirety.

BACKGROUND

1. Field

The present disclosure relates to a vacuum cleaner and a method of controlling the same, and more particularly, to a vacuum cleaner capable of selectively receiving power from an external power source and an internal power source, and a method of controlling the same.

2. Description of Related Art

A vacuum cleaner is a device for removing foreign substance such as dust on a surface to be cleaned, and generally, generates suction using a fan motor, and suctions dust on the surface to be cleaned through the generated suction.

In order to generate strong suction, the vacuum cleaner receives power from a commercial power source. To this end, a power line connects the vacuum cleaner and the commercial power outlet, and the range of motion of the vacuum cleaner is restricted due to the power line.

Accordingly, a rechargeable vacuum cleaner has been developed which is provided with an internal battery therein to receive power from the battery.

However, the rechargeable vacuum cleaner drives a fan motor only upon receiving power from a charged battery, not directly receiving power from a commercial power source.

SUMMARY

The present disclosure is directed to providing a vacuum cleaner capable of automatically supplying power to a fan motor from an external power source in response to connection to the external power source, and automatically supplying power to a fan motor from an internal power source in response to cancellation of the connection to the external power source.

Further, the present disclosure is directed to providing a vacuum cleaner capable of supplying power to one of a fan motor and an internal battery from an external power source in response to connection to the external power source, according to an operation command of a user.

One aspect of the present disclosure provides a vacuum cleaner including: a fan motor configured to generate suction; an input button configured to receive an input of a user; a first power supply circuit configured to convert alternating current (AC) power supplied from an external power source and output first direct current (DC) power; a second power supply circuit configured to store electric energy upon receiving the first DC power, and output second DC power from the stored electric energy; a driver circuit configured to drive the fan motor upon receiving at least one of the first DC power and the second DC power; a first semiconductor switching circuit configured to control the first DC power that is supplied to the second power supply circuit; a second semiconductor switching circuit configured to control the first DC power and the second DC power that are supplied to the driver circuit; and a microprocessor configured to output a control signal for turning on or off the first semiconductor switching circuit and the second semiconductor switching circuit depending on the user input and a connection state of the external power source.

The first power supply circuit may be connected to the driver circuit through a first current path, and the second power supply circuit may be connected to a first node provided on the first current path through a second current path.

The first semiconductor switching circuit may be installed on the second current path, and the second semiconductor switching circuit may be installed on the first current path between the first node and the driver circuit.

The first semiconductor switching circuit may include a first semiconductor switch and a second semiconductor switch connected in series to the first semiconductor switch.

The first semiconductor switch may include a first Metal-Oxide-Semiconductor Field Effect Transistor (MOSFET) and a first body diode connected in parallel to the first MOSFET, the second semiconductor switch may include a second MOSFET and a second body diode connected in parallel to the second MOSFET, and a cathode terminal of the first body diode may be connected to a cathode terminal of the second body diode.

The vacuum cleaner may further include a gate driver configured to output driving signals to gate terminals of the first and second MOSFETS according to the control signal of the microprocessor.

Each of the first MOSFET and the second MOSFET may be a P-type MOSFET, wherein the gate driver may include: a first step-down circuit configured to decrease a voltage of a node to which the first MOSFET and the second MOSFET are connected, and output the decreased voltage to the gate terminal of the first MOSFET; and a second step-down circuit configured to decrease a voltage of the node to which the first MOSFET and the second MOSFET are connected, and output the decreased voltage to the gate terminal of the second MOSFET.

The first step-down circuit may include a first voltage divider configured to divide a voltage of the node to which the first MOSFET and the second MOSFET are connected, and output the divided voltage to the gate terminal of the first MOSFET, and the second step-down circuit may include a second voltage divider configured to divide a voltage of the node to which the first MOSFET and the second MOSFET are connected, and output the divided voltage to the gate terminal of the second MOSFET.

Each of the first MOSFET and the second MOSFET may be a N-type MOSFET, wherein the gate driver may include: a first step-up circuit configured to increase a voltage of the first DC power and the second DC power, and output the increased voltage to the gate terminal of the first MOSFET; and a second step-up circuit configured to increase a voltage of the first DC power and the second DC power, and output the increased voltage to the gate terminal of the second MOSFET.

The first MOSFET may be a N-type MOSFET, and the second MOSFET may be a P-type MOSFET, and the gate driver may include: a first step-up circuit configured to increase e a voltage of the first DC power and the second DC power, and output the increased voltage to the gate terminal of the first MOSFET; and a second step-down circuit configured to decrease a voltage of a node to which the first MOSFET and the second MOSFET are connected, and output the decreased voltage to the gate terminal of the second MOSFET.

The first MOSFET may be a P-type MOSFET, and the second MOSFET may be a N-type MOSFET, and the gate driver may include: a first step-down circuit configured to decrease a voltage of a node to which the first MOSFET and the second MOSFET are connected, and output the decreased voltage to the gate terminal of the first MOSFET; and a second step-up circuit configured to increase a voltage of the first DC power and the second DC power, and output the increased voltage to the gate terminal of the second MOSFET.

In response to an operation command being received from the user and the external power source being connected, the microprocessor may turn off the first semiconductor switching circuit and turn on the second semiconductor switching circuit.

In response to an operation command received from the user and no external power source being connected, the microprocessor may turn on the first semiconductor switching circuit and the second semiconductor switching circuit.

In response to no operation command being received from the user and the external power source being connected, the microprocessor may turn on the first semiconductor switching circuit and turn off the second semiconductor switching circuit.

One aspect of the present disclosure provides a method of controlling a vacuum cleaner including a first power supplier for converting external power and a second power supplier for storing power supplied from the first power supplier, the method including: generating suction using DC power output from the first power supplier in response to an operation command being received from a user and the external power source being connected; generating suction using DC power output from the second power supplier in response to an operation command being received from a user and no external power source being connected; and charging the second power supplier using DC current output from the first power supplier in response to no operation command being received from a user and the external power source being connected.

The vacuum cleaner may include a first semiconductor switch for controlling DC power that charges the second power supplier and a second semiconductor switch for controlling DC power that generates suction.

The generating of suction using the DC power output from the first power supplier may include turning off the first semiconductor switch and turning on the second semiconductor switch.

The generating of suction using the DC power output from the second power supplier may include turning on the first semiconductor switch and turning on the second semiconductor switch.

The charging of the second power supplier using DC power output from the first power supplier may include turning on the first semiconductor switch and turning off the second semiconductor switch.

Another aspect of the present disclosure provides a vacuum cleaner including: a fan motor configured to generate suction; an input button configured to receive an input of a user; an external power supply circuit configured to convert alternating current (AC) power supplied from an external power source; an internal power supply circuit configured to store electric energy upon receiving the external DC power; a driver circuit configured to drive the fan motor upon receiving at least one of the external power supply circuit and the internal power supply circuit; and a microprocessor configured to perform at least one of: supplying power from the external power supply circuit to the driver circuit, supplying power from the internal power supply circuit to the driver circuit, and supplying power from the external power supply circuit to the internal power supply circuit depending on a user's input and a connection state of the external power source.

Advantageous Effects

According to an aspect of the present disclosure, the vacuum cleaner can automatically supply power to a fan motor from an external power source in response to connection to the external power source, and automatically supplying power to a fan motor from an internal power source in response to cancellation of the connection to the external power source.

According to another aspect of the present disclosure, the vacuum cleaner can supply power to one of a fan motor and an internal battery from an external power source in response to connection to the external power source, according to an operation command of a user.

BRIEF DESCRIPTION OF THE DRAWINGS

FIGS. 1A and 1B illustrate an external appearance of a vacuum cleaner according to an embodiment.

FIG. 2 illustrates an example of a power supply circuit included in the vacuum cleaner according to the embodiment.

FIG. 3 illustrates another example of a power supply circuit included in the vacuum cleaner according to the embodiment.

FIG. 4 illustrates an example of a semiconductor switch shown in FIG. 3.

FIG. 5 illustrates another example of a semiconductor switch shown in FIG. 3.

FIG. 6 illustrates another example of a semiconductor switch shown in FIG. 3.

FIG. 7 illustrates another example of a semiconductor switch shown in FIG. 3.

FIG. 8 shows a method of a vacuum cleaner supplying power to a motor according to an embodiment.

FIGS. 9 to 14 show an example in which a vacuum cleaner supplies power to a motor according to the method shown in FIG. 8.

DETAILED DESCRIPTION

The embodiments set forth herein and illustrated in the configuration of the present disclosure are nothing but the most preferred embodiment only and do not represent all the technical spirit of the present invention, so that it should be understood that various equivalents and modifications can replace them.

Hereinafter, an embodiment of the disclosure will be described in detail with reference to the accompanying drawings.

FIGS. 1A and 1B illustrate the external appearance of a vacuum cleaner according to an embodiment. Specifically, FIG. 1A shows the external appearance of a canister vacuum cleaner 1*a*, and FIG. 1B shows the external appearance of an upright vacuum cleaner 1*b*.

The vacuum cleaners 1*a* and 1*b* may drive a fan motor upon receiving power from one of an external power source and an internal power source, and draw in foreign substance, such as dust, on a surface to be cleaned through the suction generated by the fan motor. Hereinafter, the vacuum cleaner is exemplified as the canister vacuum cleaner 1*a* or the upright vacuum cleaner 1*b*, but the present disclosure is not limited thereto. For example, the vacuum cleaner is implemented as any one that can drive the fan motor upon receiving power from one of an external power source and an internal power source, such as an autonomous driving cleaner.

The canister vacuum cleaner 1*a* may include a main body 10*a*, a handle 30*a* for a user to grip, and a suction portion 20*a* to draw in air and dust on a surface to be cleaned while making contact with the surface to be cleaned. The main body 10*a*, the handle 30*a*, and the suction portion 20*a* may be connected to each other through an extension pipe 21*a* and a hose 23*a*

The suction portion 20*a* may be provided in a substantially flat shape so as to come into close contact with the surface to be cleaned, and configured to draw in air and dust on the surface to be cleaned by the suction generated by the main body 10*a*.

The handle 30*a* may be provided between the main body 10*a* and the suction portion 20*a*, and the user may grip the handle 30*a* and move the suction portion 20*a* to a desired position. The handle 30*a* may be provided with an input portion 31*a* for the user to control the operation of the vacuum cleaner 1*a*.

In addition, the handle 30*a* may have a tube shape so that the air and the dust drawn in the suction portion 20*a* may flow therein.

The extension pipe 21*a* may be provided between the suction unit 20*a* and the handle pipe 30*a*, and the extension pipe 21*a* may be formed of rigid material so that the user may move the suction port 20*a* to a desired position.

The hose 23*a* may be provided between the handle pipe 30*a* and the main body 10*a*, and the hose 23*a* may be formed of flexible material for the handle pipe 30*a* to freely move.

The suction portion 20*a*, the extension pipe 21*a*, the handle pipe 30*a*, and the hose 23*a* may be provided to communicate with each other. Therefore, the air and dust drawn in by the suction portion 20*a* may sequentially pass through the extension pipe 21*a*, the handle pipe 30*a*, and the hose 23*a* and then flow to the main body 10*a*.

The main body 10*a* may be provided with a dust collecting device 40*a*, and the air and dust flowing into the main body 10*a* may be separated from each other by the dust collecting device 40*a*.

In addition, the main body 10*a* may include various electronic devices (not shown) for controlling the operation of the vacuum cleaner 1*a* under the control of the user. In particular, the main body 10*a* may include a fan motor (not shown) that generates suction.

The main body 10*a* may include a plug 50*a* for receiving power from an external power source. In addition, the main body 10*a* may be provided therein with a battery (not shown) that stores electric energy supplied from an external power source and supplies the power to the electronic devices and the fan motor as required.

The electronic devices and fan motor installed in the main body 10*a* may operate on the power supplied from the external power source through the plug 50*a*, or operate on the power supplied from the battery provided inside the main body 10*a*.

Referring to FIG. 1B, the upright vacuum cleaner 1*b* may include a main body 10*b*, a handle 30*b* for a user to grip, and a suction portion 20*b* to draw in air and dust on a surface to be cleaned while making contact with the surface to be cleaned. In addition, the main body 10*b*, the handle 30*b*, and the suction portion 20*b* may be integrally formed with each other.

The suction portion 20*b* may be formed in a substantially flat shape so as to come into close contact with to the surface to be cleaned and may draw in air and dust on the surface to be cleaned by the suction generated by the main body 10*b*.

In addition, since the main body 10*b* and the suction portion 20*b* are integrally formed with each other, air and dust drawn in by the suction portion 20*b* may directly flow to the main body 10*b*.

The handle 30*b* may be provided at one side of the main body 10*b*, and the user may grip the handle 30*b* and move the suction portion 20*b* to a desired position. The handle 30*b* may be provided with an input portion 31*b* for the user to control the operation of the vacuum cleaner 1*b*.

The main body 10*b* may be provided with a dust collecting device 40*b*, and the air and dust flowing into the main body 10*b* may be separated from each other by the dust collecting device 40*b*.

In addition, the main body 10*b* may include various electronic devices (not shown) for controlling the operation of the vacuum cleaner 1*b* under the control of the user. In particular, the main body 10*b* may include a fan motor (not shown) that generates suction.

The main body 10*b* may include a plug 50*b* for receiving power from an external power source. In addition, the main body 10*b* may be provided at an inside thereof with a battery (not shown) that stores electric energy supplied from an external power source and supplies the power to the electronic devices and the fan motor as required.

The electronic devices and fan motor provided in the main body 10*b* may operate on the power received from the external power source through the plug 50*b* or the power received from the battery provided in the main body 10*b*.

As described above, the vacuum cleaners 1*a* and 1*b* are supplied with power from any one of the external power source and the internal power source to drive the fan motor, and draw in dust on the surface to be cleaned through the suction generated by the fan motor, regardless of the external appearance and type thereof.

In particular, the vacuum cleaners 1*a* and 1*b* may be selectively supplied with power from any one of the external power source and the internal power source depending on the operating state of the vacuum cleaner and whether the external power is supplied or not.

The following description is made in relation that the vacuum cleaners 1*a* and 1*b* select one of the external power source and the internal power source and receives power from the selected power source.

FIG. 2 illustrates an example of a power supply circuit included in a vacuum cleaner according to an embodiment of the present disclosure.

Referring to FIG. 2, the vacuum cleaner 100 includes a motor MT, a power supplier 120 for supplying power, a driver 130 for driving the motor MT, an inputter 140 for receiving a user input, and a controller 110 for controlling the operation of the electronic devices included in the vacuum cleaner 100. However, the electronic devices included in the vacuum cleaner 100 according to the embodiment are not limited to the motor MT, the power supplier 120, the driver 130, the inputter 140, and the controller 110, and may further include other various electronic devices.

The power supplier 120 may supply power to the various electronic devices included in the vacuum cleaner 100. For example, the power supplier 120 may supply power to the motor MT, the driver 130, the inputter 140, the controller 110, and the like.

The power supplier 120 may include a first power supply 121 for converting power of an external power source ES and outputting the converted power, and a second power supply 122 for storing electric energy and outputting power based on the stored electric energy.

The first power supply 121 may receive Alternating Current (AC) power from the external power source ES, and rectify the AC power to output Direct Current (DC) power.

The external power source ES may be a commercial AC power source having a voltage of 110 V or 220 V and a frequency of 50 Hz or 60 Hz, and the first power supply 121 may receive AC power from the external power source ES through a plug 50*a* or 50*b* (see FIGS. 1A and 1B).

The first power supply 121 may include a switched-mode power supply (SMPS). In detail, the first power supply 121 may include a rectifying circuit for rectifying the AC power supplied from the external power source ES, a smoothing circuit for stabilizing the rectified power to convert the stabilized power into DC power, and a voltage conversion circuit to convert the voltage of the DC power.

The DC power output from the first power supply 121 may be supplied to the second power supply 122, the driver 130, the inputter 140, and the controller 110.

In this case, the first power supply 121 may supply DC power at various voltages. For example, the first power supply 121 may supply DC power having a voltage of 5 V or 3.3V to the controller 110 composed of a digital logic circuit, and supply DC power having a voltage in a range of 10V to 20 V to the driver 130 that supplies driving current to the motor MT.

The second power supply 122 may receive DC power from the first power supply 121 and store electric energy, and supply DC power based on the stored electric energy.

The second power supply 122 may include a battery.

The DC power output by the second power supply 122 may be supplied to the driver 130, the inputter 140, and the controller 110.

As described above, the power supplier 120 including the first power supply 121 and the second power supply 122 may supply DC power using one of the first power supply 121 and the second power supply 122 according to a power control signal of the controller 110.

The motor MT may receive driving power from the driver 130 and generate a rotational force based on the supplied driving power. In addition, the rotational force by the motor MT is provided to a fan (not shown), and suction for drawing in dust and air is generated by the rotation of the fan.

The motor (MT) may be various types of motors. For example, the motor MT may be any one of a direct current motor (DC motor) including a commutator, a brushless direct current motor (BLDC motor) not including a commutator, an induction motor and a synchronous motor (a type of AC motor), and a universal motor which may operate on direct current or alternating current.

In order to aid in the understanding of the disclosure, the following description is made under the assumption that the motor MT is a DC motor or a universal motor that receives DC power.

The driver 130 may receive DC power from the first power supply 121 or the second power supply 122 and output driving power for driving the motor MT using the supplied DC power.

The driver 130 may be provided in various forms according to the type of the motor MT. As an example, when the motor MT is a DC motor or universal motor having a commutator, the driver 130 may include a pulse width modulator for outputting a pulse-width modulated DC voltage according to a driving control signal of the controller 110. As another example, when the motor MT is a BLDC motor not having a commutator, the driver 130 may include an inverter circuit for outputting a pulse-width modulated a DC voltage according to a driving control signal of the controller 110 and a rotation of the motor MT, and when the motor MT is an induction motor or a synchronous motor, the driver 130 may include an inverter circuit for outputting an AC voltage according to a driving control signal of the controller 110 and a rotation of the motor MT.

The inputter 140 may obtain various user inputs and output an electrical signal corresponding to the obtained user input. For example, the inputter 140 may obtain an operation command for starting or stopping the operation of the vacuum cleaner 100 to output an operation start signal or an operation stop signal, and may receive a user input, such as a suction strength setting, for setting the strength of suction of the vacuum cleaner 100 and output a suction strength signal as set.

The inputter 140 may include a plurality of switches for receiving predetermined commands or settings. For example, the inputter 140 may include an operation switch for receiving an operation command, a suction setting switch for receiving a suction strength setting, and the like.

In addition, the inputter 140 may obtain the user input in various ways, and may include various types of switches according to a method of obtaining the user input. For example, the inputter 140 may include a button switch that receives a user input through a user's pressing operation, a slide switch that receives a user input through a user's pushing operation, a touch switch that receives a user input through a user's touch, and a dial for receiving a user input through rotation, and the like.

The controller 110 may control the power supplier 120 and the driver 130 according to the user input and whether the external power supply ES is connected or not.

In detail, the controller 110 may control the power supplier 120 to supply DC power to the driver 130 in response to the operation start command received through the inputter 140, and may control the driver 130 to drive the motor MT.

In particular, the controller 110 may control the power supplier 120 such that DC power is supplied to the driver 130 from one of the first power supply 121 and the second power supply 122 depending on whether AC power is supplied from the external power source ES. For example, the controller 110 may control the power supplier 120 such that DC power is supplied from the first power supply 121 to the driver 130 when AC power is supplied from the external power source ES, and may control the power supplier 120 such that DC power is supplied from the second power supply 122 to the driver 130 when AC power is not supplied from the external power source ES.

In addition, the controller 110 may control the power supplier 120 such that DC power is supplied from the first power supply 121 to the second power supply 122 when AC power is supplied from the external power source ES and an operation start command is not input through the inputter 140.

The controller 110 may include a memory that stores programs and data for controlling the operation of the vacuum cleaner 100, and a microprocessor to process the data according to the programs stored in the memory.

The memory may include a nonvolatile memory that stores control data and control data for controlling the operation of the vacuum cleaner 100, and a volatile memory that temporarily stores data for operation of the microprocessor. The nonvolatile memory may include a Read Only Memory (ROM), an Erasable Programmable Read Only Memory (EPROM), an Electrically Erasable Programmable Read Only Memory (EEPROM), a flash memory, and the like, and the volatile memory may include a Static Random Access Memory (S-RAM), a Dynamic Random Access Memory (D-RAM), and the like.

The microprocessor may perform an arithmetic operation or a logical operation on data according to the programs stored in the memory. For example, the microprocessor may process user input data input through the inputter 140 and output control data corresponding to the user input. The controller 110 may transmit a control signal according to the control data output from the microprocessor to the power supplier 120 or the driver 130.

As such, the controller 110 may control the overall operation of the vacuum cleaner 100, and the operation of the vacuum cleaner 100 described below is construed as being controlled by the controller 110.

As described above, the power supplier 120 may include the first power supply 121 and the second power supply 122, and one of the first power supply 121 and the second power supply 122 may supply DC power to the driver 130 depending on a connection state of the external power source ES and a user input.

FIG. 3 illustrates another example of a power supply circuit included in the cleaner according to the embodiment. FIG. 3 is a detailed view of the power supply circuit shown in FIG. 2.

Referring to FIG. 3, a vacuum cleaner 200 includes a motor MT, a power supply circuit 220, a driver circuit 230, an input button 240, a gate driver 250, and a microprocessor 210. However, the electronic devices included in the vacuum cleaner 200 according to the embodiment are not limited to the motor MT, the power supply circuit 220, the driver circuit 230, the input button 240, the gate driver 250, and the microprocessor 210, and may further include other various electronic devices as needed.

The power supply circuit 220 includes a power conversion circuit 221, a battery circuit 222, a first semiconductor switch 223, a second semiconductor switch 224, a third semiconductor switch 225, and a diode 226.

Referring to FIG. 3, the diode 226, the first semiconductor switch 223, and the second semiconductor switch 224 may be provided between the power conversion circuit 221 and the battery circuit 222. In other words, the diode 226, the first semiconductor switch 223, and the second semiconductor switch 224 may be connected in series to each other between an output terminal out1 of the power conversion circuit 221 and an input/output terminal in/out2 of the battery circuit 222.

In addition, the third semiconductor switch 225 may be provided between a connection node n1 between the diode 226 and the first semiconductor switch 223 and an output terminal out3 of the power supply circuit 220.

In other words, a first line Line 1 connected to the power conversion circuit 221, a second line Line 2 connected to the battery circuit 222, and a third line Line 3 connected to the driver circuit 230 connect to each other in the form of an alphabetical letter "T" (or "Y"), and the diode 226 may be provided on the first line Line 1, and the first and second semiconductor switches 223 and 224 may be provided on the second line Line 2, and the third semiconductor switch 225 may be provided on the third line Line 3.

The power conversion circuit 221 may rectify commercial AC power supplied from the external power source and output rectified DC power.

The power conversion circuit 221 may include a switch-mode power supply, and the switch-mode power supply may include a rectifier circuit for rectifying AC power, a smoothing circuit for stabilizing the rectified power and converting the stabilized power into DC power, a voltage conversion circuit for converting a voltage of the DC power, and the like. In addition, the rectifier circuit may include a diode bridge, and the smoothing circuit may include a condenser. Further, the voltage conversion circuit may include a DC-DC converter.

The power conversion circuit 221 may selectively supply DC power to the battery circuit 222 and the driver circuit 230 according to the operation of the first, second, and third semiconductor switches 223, 224 and 225. For example, when the first and second semiconductor switches 223 and 224 are turned on and the third semiconductor switch 225 is turned off, the power conversion circuit 221 may supply DC power to the battery circuit 222. When the first and second semiconductor switches 223 and 224 are turned off and the third semiconductor switch 225 is turned on, the power conversion circuit 221 may supply DC power to the driver circuit 230.

The battery circuit 222 may receive DC power from the power conversion circuit 221 and may store electric energy based on the supplied DC power. In addition, the battery circuit 222 may output DC power based on the stored electric energy.

The battery circuit 222 may receive DC power from the power conversion circuit 221 according to the operation of the first, second, and third semiconductor switches 223, 224, and 225. For example, when the first and second semiconductor switches 223 and 224 are turned on and the third semiconductor switch 225 is turned off, the battery circuit 222 may receive DC power from the power conversion circuit 221.

In addition, the battery circuit 222 may supply DC power to the driver circuit 230 according to the operation of the first, second, and third semiconductor switches 223, 224, and 225. For example, when the first, second, and third semiconductor switches 223, 224, and 225 are turned on, the battery circuit 222 may supply DC power to the driver circuit 230.

The battery circuit 222 may include a battery.

The voltage between opposite electrodes of the battery may vary with the amount of electric energy stored in the battery. For example, when the amount of electric energy stored in the battery is large, the voltage between the electrodes of the battery may increase, and when the amount of electric energy stored in the battery is small, the voltage between the electrodes of the battery may decrease. Accordingly, in response to the battery discharged, DC power is supplied from the power conversion circuit 221 to the battery circuit 222 due to a difference between the voltage of the battery and the output voltage of the power conversion circuit 221. In addition, in response to the battery sufficiently charged, DC power may not be supplied from the power conversion circuit 221 to the battery since there is no difference between the voltage of the battery and the output voltage of the power conversion circuit 221.

The first, second, and third semiconductor switches 223, 224 and 225 serve to control the supply of DC power from the power conversion circuit 221 to the driver circuit 230, the supply of DC power from the power conversion circuit 221 to the battery circuit 222, and the supply of DC power from the battery circuit 222 to the driver circuit 230.

For example, when the first and second semiconductor switches 2243 and 224 are turned off and the third semiconductor switch 225 is turned on, DC power may be supplied from the power conversion circuit 221 to the driver circuit 230. In other words, DC current may be supplied from the power conversion circuit 221 to the battery circuit 222 through the third semiconductor switch 225.

As another example, when the first and second semiconductor switches 223 and 224 are turned on and the third semiconductor switch 225 is turned off, DC power may be supplied from the power conversion circuit 221 to the battery circuit 222. In other words, DC current may be supplied from the power conversion circuit 221 to the battery circuit 222 through the first and second semiconductor switches 223 and 224.

As another example, when the first, second, and third semiconductor switches 223, 224, and 225 are turned on, DC power may be supplied from the battery circuit 222 to the driver circuit 230. In other words, DC current may be supplied from the battery circuit 222 to the driver circuit 230 through the first, second, and third semiconductor switches 223, 224, and 225.

The first, second, and third semiconductor switches 223, 224, and 225 may be provided as a power semiconductor device. For example, the first, second, and third semiconductor switches 223, 224, and 225 may be provided using a Power Metal-Oxide-Semiconductor Field Effect Transistor (Power MOSFET) a Junction Field Effect Transistor (JFET), an Insulated Gate Bipolar Transistor (IGBT), a Bipolar Junction Transistor (BJT), a Thyristor, etc.

IGBTs or BJTs have a small switching loss during ON/OFF switching, but have a large conduction loss in an ON state. Meanwhile, the power MOSFET has a small conduction loss in an ON state.

In this case, the first, second, and third semiconductor switches 223, 224, and 225 used for the power supply circuit 220 have a small number of ON/OFF switching operations, but has a long retention time of ON or OFF state. That is, the first, second, and third semiconductor switches 223, 224, and 225 used for the power supply circuit 220 are significantly affected by the conduction loss rather than by the switching loss.

Accordingly, the first, second, and third semiconductor switches 223, 224, and 225 may preferably employ a power MOSFET rather than an IGBT or BJTs.

In order to aid in the understanding of the disclosure, the following description will be made under the assumption that the first, second, and third semiconductor switches 223, 224, and 225 are power MOSFETs.

The diode 226 may interrupt output current of the battery circuit 222 such that DC power output from the battery circuit 222 is prevented from being supplied to the power conversion circuit 221 when DC power is supplied from the battery circuit 222 to the driver circuit 230.

In detail, the diode 226 may allow DC power to be output from the output terminal out1 of the power conversion circuit 221, while interrupting DC power being input to the output terminal out1 of the power conversion circuit 221.

The diode 226 may be provided using a PIN diode, a Schottky diode, and the like.

The motor MT may receive driving power from the driver circuit 230 and generate a rotational force based on the supplied driving power. In addition, a rotational force generated by the motor MT is provided to a fan (not shown), and suction for drawing in dust and air is generated by the rotation of the fan.

The motor MT may be provided using various motors. For example, the motor MT may be provided using one of a DC motor including a commutator, a BLDC motor not including a commutator, an induction motor and a synchronous motor, which are a type of AC motor, and a universal motor that operates on DC or AC.

Hereinafter, in order to aid in the understanding of the present disclosure, the following description is made under the assumption that the motor (MT) is a DC motor or a universal motor supplied with DC power.

The driver circuit 230 may receive DC power from the power conversion circuit 221 or the battery circuit 222 and output the driving power for driving the motor MT using the supplied DC power.

The driver circuit 230 may be provided in various forms according to the type of the motor MT. For example, when the motor MT is a DC motor or universal motor having a commutator, the driver 130 may include a pulse width converter for outputting a pulse-width modulated DC voltage according to a driving control signal of the controller 110.

The input button 240 may receive a user input and output an electrical signal corresponding to the received user input. For example, the input button 240 may, for example, obtain an operation command for starting or stopping the operation of the vacuum cleaner 100, and output an operation start signal or an operation stop signal.

The microprocessor 210 may output a power control signal for controlling the first, second, and third semiconductor switches 223, 224, and 225 according to a user input and whether a connection of an external power source ES is established.

For example, when AC power is supplied from the external power source ES and an operation start command is input from the user, the microprocessor 210 may output a power control signal for turning off the first and second semiconductor switches 223 and 224 and turning on the third semiconductor switch 225. In addition, upon turning off of the first and second semiconductor switches 223 and 224, and turning on of the third semiconductor switch 225, DC power may be supplied from the power conversion circuit 221 to the driver circuit 230.

As another example, when AC power is not supplied from the external power source ES and an operation start command is input from a user, the microprocessor 210 may output a control signal for turning on the first, second, and third semiconductor switches 223, 224, and 225. Upon turning on of the first, second, and third semiconductor switches 223, 224, and 225, DC power may be supplied from the battery circuit 222 to the driver circuit 220.

As another example, when AC power is supplied from the external power source ES and an operation start command is not input from the user, the microprocessor 210 may output a power control signal for turning on the first and second semiconductor switches 223 and 224, and turning off the third semiconductor switch 225. Upon turning on of the first and second semiconductor switches 223 and 224 and turning off of the third semiconductor switch 223, 224 and 225, DC power is supplied from the power conversion circuit 221 to the battery circuit 222. In other words, the battery of the vacuum cleaner 200 is charged.

As another example, when AC power is not supplied from the external power source ES and an operation start command is not input from the user, the microprocessor 210 may output a power control signal for turning off the first, second, and third semiconductor switches 223, 224, 225. Upon turning off of the first, second, and third semiconductor switches 223, 224 and 225, the vacuum cleaner 200 may maintain a standby state.

The microprocessor 210 includes a memory block that stores programs and data for generating a power control signal according to a user input and a connection state of the external power source ES and a process block that processes the user input and the connection state of the external power source ES according to the programs stored in the memory block.

The gate driver 260 may output gate driving signals for driving the first, second, and third semiconductor switches 223, 224, and 225 according to the power control signal output from the microprocessor 210.

An output DC voltage of the power conversion circuit 221, an input/output DC voltage of the battery circuit 222, and a driving voltage of the driver circuit 230 are greater than a driving DC voltage of the microprocessor 210, and voltages to turn on and off the first, second, and third semiconductor switches 223, 224, and 225 connected to the power conversion circuit 221, the battery circuit 222, and the driver circuit 230 are also greater than the driving DC voltage of the microprocessor 210.

For example, the microprocessor 210 may be implemented as a Transistor Transistor Logic (TTL) circuit or a Complementary Metal-Oxide Semiconductor (CMOS) circuit, and is supplied with a DC voltage of 3.3V or 5V, and the power control signal may be a signal of 3.3V or 5V. In contrast, the output DC voltage of the power conversion circuit 221, the input/output DC voltage of the battery circuit 222 and the driving voltage of the driver circuit 230 are DC voltages of 20V. Accordingly, the first, second, and third semiconductor switches 223, 224, and 225 need to conduct or interrupt DC voltage of 20V, and in order to turn on the first, second, and third semiconductor switches 223, 224, and 225, DC voltage of about 10 V or more is required.

Accordingly, in order to turn on and off the first, second, and third semiconductor switches 223, 224, and 225 according to the power control signal output from the microprocessor 210, the power control signal needs to be boosted to a high voltage.

The gate driver 260 may boost the power control signal output from the microprocessor 210 and output the boosted power control signal, that is, a gate driving signal, to the first, second, and third semiconductor switches 223, 224, and 225.

As described above, the vacuum cleaner 200 may include the power conversion circuit 221, the battery circuit 222, the first, second, and third semiconductor switches 223, 224, and 225, and the driver circuit 230, and the first and second semiconductor switches 223 and 224 may be provided between the power conversion circuit 221 and the battery circuit 222 and the third semiconductor switch 225 may be provided between the power conversion circuit 221 and the driver circuit 230. The first, second, and third semiconductor switches 223, 224 and 225 may be individually turned on or off depending on the connection state of the external power source ES and the user input, and according to ON or OFF of the first, second and third semiconductor switches 223, one of the power conversion circuit 221 and the battery circuit 222 may supply DC power to the driver circuit 230, and the power conversion circuit 221 may supply DC power to one of the battery circuit 222 and the driver circuit 230.

FIG. 4 illustrates an example of the semiconductor switch shown in FIG. 3.

Referring to FIG. 4, the first semiconductor switch 223 may include a first n-type MOSFET 223*n* and a first body diode 223*d*.

The first n-type MOSFET 223*n* may conduct or interrupt current from a first drain terminal D 1 to a first source terminal S 1 according to a first input voltage Vgs1 between a first gate terminal G1 and the first source terminal S1. In detail, when a voltage is applied to the first gate terminal G1, a channel composed of electrons, that is, negative charges, is formed between the first drain terminal D1 and the first source terminal S1, and due to a voltage between the first drain terminal D1 and the first source terminal S1, electrons of the channel move from the first source terminal S1 to the first drain terminal D1. As a result, a current may flow from the first drain terminal D1 to the first source terminal S1.

The first body diode 223*d* may be connected in parallel to the first n-type MOSFET 223*n*. In detail, a first anode terminal A1 of the first body diode 223*d* may be connected to the first source terminal S1 of the first n-type MOSFET 223*n*, and a first cathode terminal C1 of the first body diode 223*d* may be connected to the first drain terminal D1 of the first n-type MOSFET 223*n*.

The first body diode 223*d* may prevent the first n-type MOSFET 223*n* from being damaged. For example, when the first n-type MOSFET 223*n* is turned off, a large electromotive force may be generated due to the inductance inside the circuit, and the first n-type MOSFET 223*n* may be damaged due to electromotive force. The first body diode 223*d* may conduct current caused by the electromotive force, and thus damage to the first n-type MOSFET 223*n* is prevented.

The second semiconductor switch 224 may include a second n-type MOSFET 224*n* and a second body diode 224*d*.

The second n-type MOSFET 224*n* may conduct or interrupt current from a second drain terminal D2 to a first source terminal S2 according to a second input voltage Vgs2 between a second gate terminal G2 and the second source terminal S2.

The second body diode 224*d* may be connected in parallel to the second n-type MOSFET 224*n*. In detail, a second anode terminal A2 of the second body diode 224*d* may be connected to the second source terminal S2 of the second n-type MOSFET 224*n*, and a second cathode terminal C2 of the second body diode 224*d* may be connected to the second drain terminal D2 of the second n-type MOSFET 224*n*. In addition, the second body diode 224*d* may prevent the second n-type MOSFET 224*n* from being damaged by an electromotive force caused by the inductance inside the circuit.

In this case, the first drain terminal D1 of the first n-type MOSFET 223*n* and the second drain terminal D2 of the second n-type MOSFET 224*n* may be connected to each other, and the first cathode terminal C1 of the first body diode 223*d* and the second cathode terminal C2 of the second body diode 223*d* may be connected to each other. In addition, the first source terminal S1 of the first n-type MOSFET 223*n* is connected to the power conversion circuit 221 and the driver circuit 230, and the second source terminal S2 of the second n-type MOSFET 223*n* may be connected to the battery circuit 222.

The gate driver 250 may include a first step-up circuit 251*a* for driving the first n-type MOSFET 223*n* and a second step-up circuit 251*a* for driving the second n-type MOSFET 224*n*.

A voltage applied to the gate driver 250 is equal to a voltage applied to the first n-type MOSFET 223*n* and the second n-type MOSFET 224*n*. In other words, the power supply voltage of the gate driver 250 is equal to the voltage of the first source terminal S1 applied by the power conversion circuit 221 and the voltage of the second source terminal S2 applied by the battery circuit 222. For example, when the power conversion circuit 221 and the battery circuit 222 output DC power of 20 V, the voltage of the first source terminal S1 and the voltage of the second source terminal S2 are each 20V, and a voltage applied to the gate driver 250 is also 20V.

Meanwhile, in order to turn on the first n-type MOSFET 223*n*, the voltage of the first gate terminal G1 needs to be greater than the voltage of the first source terminal S1. In other words, when the first input voltage Vgs1 between the first source terminal S1 and the first gate terminal G1 is greater than a positive threshold voltage, the first n-type MOSFET 223*n* is turned on. For example, when the power conversion circuit 221 and the battery circuit 222 output DC power of 20V and the threshold voltage of the first n-type MOSFET 223*n* is +1 V, a voltage greater than 25V needs to be applied to the first gate terminal G1 to turn on the first n-type MOSFET 223*n*.

Since the supply voltage of the gate driver 250 is equal to the voltage of the first source terminal S 1 as described above, the gate driver 250 may include the first step-up circuit 251*a* that increases a voltage and outputs the increased voltage to turn on the first n-type MOSFET 223*n*.

The first step-up circuit 251*a* may be implemented in various circuits. For example, the first step-up circuit 251*a* may be implemented as a boost converter, a buck-boost converter, a flyback converter, a charge pump, and the like.

For the same reason as above, the gate driver 250 may include the second step-up circuit 252*a* for increasing the supply voltage to turn on the second n-type MOSFET 224*n*.

As described above, the first and second semiconductor switches 223 and 224 may include the first and second n-type MOSFETs 223*n* and 224*n*, respectively, and the gate driver 250 may include the first and second step-up circuits 251*a* and 252*a*.

FIG. 5 illustrates another example of the semiconductor switch shown in FIG. 3.

Referring to FIG. 5, the first semiconductor switch 223 may include a first p-type MOSFET 223*p* and a first body diode 223*d*.

The first p-type MOSFET 223*p* may conduct or interrupt current from a first source terminal S1 to a first drain terminal D1 according to a first input voltage Vgs1 between a first gate terminal G1 and the first source terminal S1. In detail, when a voltage is applied to the first gate terminal G1, a channel composed of holes, that is, positive charges, is formed between the first drain terminal D1 and the first source terminal S1, and due to a voltage between the first source terminal S1 and the first drain terminal D1, holes of the channel move from the first source terminal S1 to the first drain terminal D1. As a result, current may flow from the first source terminal S1 to the first drain terminal D1.

The first body diode 223*d* may be connected in parallel to the first p-type MOSFET 223*p*. In detail, a first anode terminal A1 of the first body diode 223*d* may be connected to the first drain terminal D1 of the first P-type MOSFET 223*p*, and a first cathode terminal C1 of the first body diode 223*d* may be connected to the first source terminal S1 of the first p-type MOSFET 223*p*. In addition, the first body diode 223*d* may prevent the first p-type MOSFET 223*p* from being damaged due to the electromotive force caused by the inductance inside the circuit.

The second semiconductor switch 224 may include a second n-type MOSFET 224*n* and a second body diode 224*d*.

The second n-type MOSFET 224*n* may conduct or interrupt current from a second drain terminal D2 to a first source terminal S2 according to a second input voltage Vgs2 between a second gate terminal G2 and the second source terminal S2.

The second body diode 224*d* may be connected in parallel to the second n-type MOSFET 224*n*. In detail, a second anode terminal A2 of the second body diode 224*d* may be connected to the second source terminal S2 of the second n-type MOSFET 224*n*, and a second cathode terminal C2 of the second body diode 224*d* may be connected to the second drain terminal D2 of the second n-type MOSFET 224*n*. In addition, the second body diode 224*d* may prevent the second n-type MOSFET 224*n* from being damaged by an electromotive force caused by the inductance inside the circuit.

In this case, the first source terminal S1 of the first p-type MOSFET 223*p* and the second drain terminal D2 of the second n-type MOSFET 224*n* may be connected to each other, and the first cathode terminal C1 of the first body diode 223*d* and the second cathode terminal C2 of the second body diode 223*d* may be connected to each other. In addition, the first drain terminal D1 of the first p-type MOSFET 223*p* may be connected to the power conversion circuit 221 and the driver circuit 230, and the second source terminal S2 of the second n-type MOSFET 223*n* may be connected to the battery circuit 222.

The gate driver 250 may include a first step-down circuit 251*b* for driving the first p-type MOSFET 223*p* and a second step-up circuit 251*a* for driving the second n-type MOSFET 224*n*.

A voltage applied to the gate driver 250 is equal to a voltage applied to the first p-type MOSFET 223*p* and the second n-type MOSFET 224*n*. For example, when the power conversion circuit 221 and the battery circuit 222 output DC power of 20 V, the voltage of the first drain terminal D1 and the voltage of the second source terminal S2 are each 20V, and the voltage applied to the gate driver 250 is also 20V.

Meanwhile, in order to turn on the first p-type MOSFET 223*p*, the voltage of the first gate terminal G1 needs to be smaller than the voltage of the first source terminal S1. In other words, when the first input voltage Vgs1 between the first source terminal S1 and the first gate terminal G1 is smaller than a negative threshold voltage, the first p-type MOSFET 223*p* is turned on. For example, when the power conversion circuit 221 and the battery circuit 222 output DC power of 20V and the threshold voltage of the first p-type MOSFET 223*p* is −10V, a voltage smaller than 10V needs to be applied to the first gate terminal G1 to turn on the first p-type MOSFET 223*p*.

Since the supply voltage of the gate driver 250 is equal to the voltage of the first drain terminal D1 as described above, the gate driver 250 may include the first step-down circuit 251*b* that decreases a voltage and outputs the decreased voltage to turn on the first p-type MOSFET 223*p*.

The first step-down circuit 251*b* may be implemented in various circuits. For example, the first step-up circuit 251*a* may be implemented using a buck converter, a buck-boost converter, a flyback converter, a voltage divider, and the like.

In particular, when the first step-down circuit 251*b* is implemented as a voltage divider, the first step-down circuit 251*b* may divide a voltage of a node to which the first p-type MOSFET 223*p* and the second n-type MOSFET 224*n* are connected and apply the divided voltage to the first gate terminal G1 of the first p-type MOSFET 223*p*.

For example, referring to FIG. 5, the first step-down circuit 251*b* may include a first resistor R1, a second resistor R2, and a first switching element Q1. At this time, the first resistor R1, the second resistor R2, and the first switching element Q1 may be connected in series. One end of the first resistor R1 may be connected to a node to which the first p-type MOSFET 223*p* and the second n-type MOSFET 224*n* are connected. A node to which the first resistor R1 and the second resistor R2 are connected may be connected to the first gate terminal G1 of the first p-type MOSFET 223*p*.

The output voltage of the power conversion circuit 221 or the output voltage of the battery circuit 222 may be applied to one end of the first resistor R 1 by the first and second body diodes 223*d* and 224*d*. In detail, since the first anode terminal A1 of the first body diode 223*d* is connected to the power conversion circuit 221 and the first cathode terminal C1 is connected to one end of the first resistor R1, the output voltage of the power conversion circuit 221 may be applied to the one end of the first resistor R1. Since the second anode terminal A2 of the second body diode 224*d* is connected to the battery circuit 222 and the second cathode terminal C2 is connected to one terminal of the first resistor R1, the output voltage of the battery circuit 222 may be applied to the one end of the first resistor R1.

In addition, the voltage applied to the first gate terminal G 1 may vary with ON/OFF operation of the first switching element Q 1. When the first switching element Q1 is turned on, the output voltage of the power conversion circuit 221 or the output voltage of the battery circuit 222 is divided by the first resistor R1 and the second resistor R2, and the divided voltage is applied to the first gate terminal G1. As a result, the first p-type MOSFET 223*p* is turned on. For example, when the output voltage of the power conversion circuit 221 and the output voltage of the battery circuit 222 are each 20 V and the resistance value of the first resistor R1 is equal to the resistance value of the second resistor R2, a voltage of 10V may be applied to the first gate terminal G1. At this time, since the voltage of the first source terminal S1 is 20V and the voltage of the first gate terminal G1 is 10V, the first input voltage Vgs becomes −10 V. When the threshold voltage of the first p-type MOSFET 223*p* is −1V, the first p-type MOSFET 223*p* is turned on.

In addition, when the first switching element Q1 is turned off, the output voltage of the power conversion circuit 221 or the output voltage of the battery circuit 222 is applied to the first gate terminal G1 through the first resistor R1. As a result, the first p-type MOSFET 223*p* is turned off. For example, when the output voltage of each of the power conversion circuit 221 and the battery circuit 222 is 20 V, a voltage of 20V is applied to the first gate terminal G1. Since the voltage of the first source terminal S1 is 20V and the voltage of the first gate terminal G1 is 20V, the first input voltage Vgs becomes 0V, and the first p-type MOSFET 223*p* is turned off.

In order to turn on the second n-type MOSFET 224*n*, the voltage of the second gate terminal G2 needs to be greater than the voltage of the second source terminal S2. For example, when the power conversion circuit 221 and the battery circuit 222 each output DC power of 20 [V] and the threshold voltage of the second n-type MOSFET 224*n* is +1V, a voltage greater than 25V needs to be applied to the first gate terminal G1 to turn on the first n-type MOSFET 223*n*.

Since the supply voltage of the gate driver 250 is the equal to the voltage of the second source terminal S2 as described above, the gate driver 250 may include the second step-up circuit 252*a* that increases a voltage and outputs the increased voltage to turn on the second n-type MOSFET 224*n*.

The first step-up circuit 251*a* may be implemented in various circuits, for example, a boost converter, a buck-boost converter, a flyback converter, a charge pump, and the like.

As described above, the first semiconductor switch 224 may include the first p-type MOSFET 223*p*, and the second semiconductor switch 224 may include the second n-type MOSFET 224*n*, and the gate driver 250 may include the step-down circuit 251*b* and the second step-up circuit 252*a*.

FIG. 6 illustrates another example of the semiconductor switch shown in FIG. 3.

Referring to FIG. 6, the first semiconductor switch 223 may include a first n-type MOSFET 223*n* and a first body diode 223*d*.

The first n-type MOSFET 223*n* may conduct or interrupt current from a first drain terminal D1 to a first source terminal S1 according to a first input voltage Vgs1 between a first gate terminal G1 and the first source terminal S1.

The first body diode 223*d* may be connected in parallel to the first n-type MOSFET 223*n*. In detail, a first anode terminal A1 of the first body diode 223*d* may be connected to the first source terminal S1 of the first n-type MOSFET 223*n*, and a first cathode terminal C1 of the first body diode 223*d* may be connected to the first drain terminal D1 of the first n-type MOSFET 223*n*. In addition, the first body diode 223*d* may prevent the first n-type MOSFET 223*n* from being damaged due to the electromotive force caused by the inductance inside the circuit.

The second semiconductor switch 224 may include a second p-type MOSFET 224*p* and a second body diode 224*d*.

The second p-type MOSFET 224*p* may conduct or interrupt current from a second source terminal S2 to a second drain terminal D2 according to a second input voltage Vgs2 between a second gate terminal G2 and the second source terminal S2.

The second body diode 224*d* may be connected in parallel to the second p-type MOSFET 224*p*. In detail, a second anode terminal A2 of the second body diode 224*d* may be connected to the second drain terminal D2 of the second p-type MOSFET 224*p*, and a second cathode terminal C2 of the second body diode 224*d* may be connected to the second source terminal S2 of the second p-type MOSFET 224*p*. In addition, the second body diode 224*d* may prevent the second p-type MOSFET 224*p* from being damaged by an electromotive force caused by the inductance inside the circuit.

In this case, the first drain terminal D1 of the first n-type MOSFET 223*n* and the second source terminal S2 of the second p-type MOSFET 224*p* may be connected to each other, and the first cathode terminal C1 of the first body diode 223*d* and the second cathode terminal C2 of the second body diode 223*d* may be connected to each other. In addition, the first source terminal S1 of the first n-type MOSFET 223*n* may be connected to the power conversion circuit 221 and the driver circuit 230, and the second drain terminal D2 of the second p-type MOSFET 223*p* may be connected to the battery circuit 222.

The gate driver 250 may include a first step-up circuit 251*a* for driving the first n-type MOSFET 223*n* and a second step-down circuit 252*b* for driving the second p-type MOSFET 224*p*.

A voltage applied to the gate driver 250 is equal to a voltage applied to the first n-type MOSFET 223*n*, and in order to turn on the first n-type MOSFET 223*n*, the voltage of the first gate terminal G1 needs to be greater than the voltage of the first source terminal S1, and thus the gate driver 250 may include the first step-up circuit 251*a* that increases a voltage and outputs the increased voltage to turn on the first n-type MOSFET 223*n*. The first step-up circuit 251*a* may be implemented in various circuits, for example, a boost converter, a buck-boost converter, a flyback converter, a charge pump, and the like.

In addition, a voltage applied to the gate driver 250 is equal to a voltage applied to the second p-type MOSFET 224*p*, and in order to turn on the second p-type MOSFET 224*p*, the voltage of the second gate terminal G2 needs to be smaller than the voltage of the second source terminal S1, and thus the gate driver 250 may include the second step-down circuit 252*b* that decreases a voltage and outputs the decreased voltage to turn on the second p-type MOSFET 224*p*. The second step-down circuit 252*b* may be implemented in various circuits, for example, a buck converter, a buck-boost converter, a flyback converter, a voltage divider, and the like.

In particular, when the second step-down circuit 252*b* is implemented as a voltage divider, the second step-down circuit 252*b* may divide a voltage of a node to which the first n-type MOSFET 223*n* and the second p-type MOSFET 224*p* are connected, and apply the divided voltage to the second gate terminal G2 of the second p-type MOSFET 224*p*.

For example, referring to FIG. 6, the second step-down circuit 252*b* may include a third resistor R3, a fourth resistor R4, and a second switching element Q2. At this time, the third resistor R3, the fourth resistor R4, and the second switching element Q2 may be connected in series. One end of the third resistor R3 may be connected to a node to which the first n-type MOSFET 223*n* and the second p-type MOSFET 224*p* are connected. A node to which the third resistor R3 and the fourth resistor R4 are connected may be connected to the second gate terminal G2 of the second p-type MOSFET 224*p*.

The output voltage of the power conversion circuit 221 or the output voltage of the battery circuit 222 may be applied to the one end of the third resistor R 3 by the first body diode 223*d* and the second body diode 224*d*.

In addition, a voltage applied to the one end of the third resistor R3 may be applied to the second gate terminal G2 as it is or a voltage applied to the one end of the third resistor R3 may be divided by the third and fourth resistors R3 and R4 and the divided voltage may be applied to the second gate terminal G2 depending on ON/OFF operation of the second switching element Q2.

For example, when the second switching element Q2 is turned on, the output voltage of the power conversion circuit 221 or the output voltage of the battery circuit 222 is divided by the third and fourth resistors R3 and R4 and the divided voltage is applied to the second gate terminal G2. As a result, the second p-type MOSFET 224*p* is turned on.

In addition, when the second switching element Q2 is turned off, the output voltage of the power conversion circuit 221 or the output voltage of the battery circuit 222 is applied to the second gate terminal G2 through the third resistor R3. As a result, the second p-type MOSFET 224*p* is turned off.

As described above, the first semiconductor switch 223 may include the first n-type MOSFET 223*n*, and the second semiconductor switch 224 may include the second p-type MOSFET 224*p*, and the gate driver 250 may include the step-up circuit 251*a* and the second step-down circuit 252*b*.

FIG. 7 illustrates another example of the semiconductor switch shown in FIG. 3.

Referring to FIG. 7, the first semiconductor switch 223 may include a first p-type MOSFET 224*p* and a first body diode 223*d*.

The first p-type MOSFET 223*p* may conduct or interrupt current from a first source terminal S1 to a first drain terminal D1 according to a first input voltage Vgs1 between a first gate terminal G 1 and the first source terminal S1.

The first body diode 223*d* may be connected in parallel to the first p-type MOSFET 223*p*. In detail, a first anode terminal A1 of the first body diode 223*d* may be connected to the first drain terminal D1 of the first p-type MOSFET 223*p*, and a first cathode terminal C1 of the first body diode 223*d* may be connected to the first source terminal S1 of the first p-type MOSFET 223*p*. In addition, the first body diode 223*d* may prevent the first p-type MOSFET 223*p* from being damaged due to the electromotive force caused by the inductance inside the circuit.

The second semiconductor switch 224 may include a second p-type MOSFET 224*p* and a second body diode 224*d*.

The second p-type MOSFET 224*p* may conduct or interrupt current from a second source terminal S2 to a second drain terminal D2 according to a second input voltage Vgs2 between a second gate terminal G2 and the second source terminal S2.

The second body diode 224*d* may be connected in parallel to the second p-type MOSFET 224*p*. In detail, a second anode terminal A2 of the second body diode 224*d* may be connected to the second drain terminal D2 of the second p-type MOSFET 224*p*, and a second cathode terminal C2 of the second body diode 224*d* may be connected to the second source terminal S2 of the second p-type MOSFET 224*p*. In addition, the second body diode 224*d* may prevent the second p-type MOSFET 224*p* from being damaged by an electromotive force caused by the inductance inside the circuit.

In this case, the first source terminal S1 of the first p-type MOSFET 223*p* and the second source terminal S2 of the second p-type MOSFET 224*p* may be connected to each other, and the first cathode terminal C1 of the first body diode 223*d* and the second cathode terminal C2 of the second body diode 223*d* may be connected to each other. In addition, the first drain terminal D1 of the first p-type MOSFET 223*p* may be connected to the power conversion circuit 221 and the driver circuit 230, and the second drain terminal D2 of the second p-type MOSFET 223*p* may be connected to the battery circuit 222.

The gate driver 250 may include a first step-down circuit 251*b* for driving the first p-type MOSFET 223*p* and a second step-down circuit 252*b* for driving the second p-type MOSFET 224*p*.

A voltage applied to the gate driver 250 is equal to a voltage applied to the first p-type MOSFET 223*p*, and in order to turn on the first p-type MOSFET 223*p*, the voltage of the first gate terminal G1 needs to be smaller than the voltage of the first source terminal S1, and thus the gate driver 250 may include the first step-down circuit 251*b* that decreases a voltage and outputs the decreased voltage to turn on the first p-type MOSFET 223*p*. The first step-down circuit 251*b* may be implemented in various circuits, for example, a buck converter, a buck-boost converter, a flyback converter, a voltage divider, and the like.

In particular, when the first step-down circuit 251*b* is implemented as a voltage divider, the first step-up circuit 251*b* may divide a voltage of a node to which the first p-type MOSFET 223*p* and the second p-type MOSFET 224*p* are connected and apply the divided voltage to the first gate terminal G1 of the first p-type MOSFET 223*p*.

For example, referring to FIG. 7, the first step-down circuit 251*b* may include a first resistor R1, a second resistor R2, and a first switching element Q1. At this time, the first resistor R1, the second resistor R2, and the first switching element Q1 may be connected in series. One end of the first resistor R1 may be connected to a node to which the first p-type MOSFET 223*p* and the second p-type MOSFET 224*p* are connected. A node to which the first resistor R1 and the second resistor R2 are connected may be connected to the first gate terminal G1 of the first p-type MOSFET 223*p*.

The output voltage of the power conversion circuit 221 or the output voltage of the battery circuit 222 may be applied to the one end of the first resistor R1 by the first and second body diodes 223*d* and 224*d*. In addition, a voltage applied to the first resistor R1 may be applied to the first gate terminal G1 as it is or a voltage applied to the first resistor R1 may be divided by the first and second resistors R1 and R2 and the divided voltage may be applied to the first gate terminal G1 depending on ON/OFF operation of the first switching element Q1.

For the same reason as the above, the gate driver 250 includes the second step-down circuit 252*b* for decreasing a voltage and outputting the decreased voltage to turn on the second p-type MOSFET 224*p*. The second step-down circuit 252*b* may be implemented in various circuits, for example, a buck converter, a buck boost converter, a flyback converter, a voltage divider, and the like.

In addition, when the second step-down circuit 252*b* is implemented as a voltage divider, the second step-down circuit 252*b* may divide a voltage of a node to which the first p-type MOSFET 223*p* and the second p-type MOSFET 224*p* are connected and apply the divided voltage to the second gate terminal G2 of the second p-type MOSFET 224*p*.

As described above, the first semiconductor switch and the second semiconductor switch 224 may include the first p-type MOSFET 223*p* and the second p-type MOSFET 224*p*, respectively, and the gate driver 250 may include the first and second step-down circuits 251*b* and 252*b*.

In the above, the construction of the vacuum cleaner has been described.

Hereinafter, the operation of the vacuum cleaner will be described.

FIG. 8 shows a method of a vacuum cleaner supplying power to a motor according to an embodiment. FIGS. 9 to 14 show an example in which a vacuum cleaner supplies power to a motor according to the method shown in FIG. 8.

A method of supplying power (1000), in which a vacuum cleaner supplies power to a motor, is described with reference to FIGS. 8 to 14.

Referring to FIGS. 9 to 14, a vacuum cleaner 300 may include a controller 310, a power supplier 320, a driver 330, and an inputter 340, and the power supplier 320 may include a power conversion circuit 321, a battery circuit 322, and first, second, and third semiconductor switches 323, 324 and 325.

The vacuum cleaner 300 determines whether a cleaning operation is performed (1010).

The determination, by the controller 310 of the cleaner 300, whether the cleaning operation is performed may be achieved in various ways.

For example, the controller 310 may determine whether a cleaning operation is performed, based on a user input inputted through the inputter 340. When an operation start command is input by a user through the inputter 340, the controller 310 may determine that a cleaning operation is performed. In addition, when an operation start command is not input by a user through the inputter 340 or an operation stop command is input by a user through the inputter 340, the controller 310 may determine that a cleaning operation is not performed.

As another example, the controller 310 may determine whether a cleaning operation is performed, based on whether a motor MT is driven or not. When the motor MT is being driven, the controller 310 may determine that a cleaning operation is performed. In addition, when the motor MT is not being driven, the controller 310 may determine that a cleaning operation is not performed.

As another example, the controller 310 may determine whether a cleaning operation is performed, based on data stored in a memory. When an operation start command is inputted by a user through the inputter 340, the controller 310 may store data indicating a cleaning state in the memory, and when an operation stop command is input by a user, the controller 310 may store data indicating a standby state in the memory. In addition, in response to the data indicating the cleaning state stored in the memory, the controller 310 may determine that a cleaning operation is performed, and in response to the data indicating a standby state stored in the memory, the controller 310 may determine that a cleaning operation is stopped.

When it is determined in operation 1010 that a cleaning operation is performed (YES in operation 1010), the vacuum cleaner 300 determines whether an external power source is connected (1020).

The determination, by the controller 310 of the vacuum cleaner 300, whether an external power source is connected may be achieved in various ways.

For example, the controller may determine whether an external power source is connected, based on the output of the power conversion circuit 321 that rectifies AC power supplied from an external power source and outputs rectified DC power. When the power conversion circuit 321 outputs DC power, the controller 310 determines that an external power source is connected, and when the power conversion circuit 321 does not output DC power, the controller 310 determines that an external power source is not connected.

As another example, the controller 310 may determine whether an external power source is connected, based on whether AC power is supplied from an external power source. In detail, a current sensor or a voltage sensor capable of detecting AC power supplied from an external power source may be provided, and the controller 310 may determine whether an external power source is connected, based on the output of the current sensor or the voltage sensor.

As another example, the controller 310 may determine whether an external power source is connected, based on whether or not a plug is inserted. In detail, a pressure sensor or a proximity sensor capable of detecting whether a plug is inserted into a socket may be provided, and the controller 310 may determine whether an external power source is connected, based on the output of the pressure sensor or the proximity sensor.

When it is determined in operation 1020 that an external power source is connected (YES in operation 1020), the vacuum cleaner 300 supplies DC power to the driver 330 from the external power source (1030).

The controller 310 of the vacuum cleaner 300 may control the power supplier 320 to supply DC power to the driver 330 from the power conversion circuit 321.

In detail, the controller 310 may turn off the first and second semiconductor switches 323 and 324 connected to the battery circuit 322, and turn on the third semiconductor switch 325 connected to the driver 330.

When the first and second semiconductor switches 323 and 324 are turned off and the third semiconductor switch 325 is turned on, current Is1 output from the power conversion circuit 321 is supplied to the driver 330 as shown in FIG. 9.

When it is determined in operation 1020 that no external power source is connected (NO in operation 1020), the vacuum cleaner 300 supplies DC power to the driver 330 from the internal power source (1040).

The controller 310 of the cleaner 300 may control the power supplier 320 to supply DC power to the driver 330 from the battery circuit 322.

In detail, the controller 310 may turn on the first and second semiconductor switches 323 and 324 connected to the battery circuit 322 and the third semiconductor switch 325 connected to the driver 330.

When the first, second, and third semiconductor switches 323, 324, and 325 are turned on, current Is2 output from the battery circuit 322 is supplied to the driver 330 as shown in FIG. 10.

When the first semiconductor switch 323 includes a first MOSFET 323*a* and a first body diode 323*b* and the second semiconductor switch 324 includes a second MOSFET 324*a* and a second body diode 324*b*, the first MOSFET 323*a* may be turned on and the second MOSFET 324*a* may be turned off. Current Is2 outputted from the battery circuit 322 may be supplied to the driver 330 through the second body diode 324*b* and the first MOSFET 323*a* as shown in FIG. 11, even when the second MOSFET 324*a* is turned off.

When it is determined in operation 1010 that a cleaning operation is not performed (YES in operation 1010), the vacuum cleaner 300 determines whether an external power source is connected (1050).

As described above in operation 1020, the determination, by the controller 310 of the vacuum cleaner 300, whether an external power source is connected may be achieved in various methods.

When it is determined in operation 1050 that an external power source is connected (YES in operation 1050), the vacuum cleaner 300 supplies DC power to the internal power source from the external power source (1060).

The controller 310 of the vacuum cleaner 300 may control the power supplier 320 to supply DC power to the battery circuit 232 from the power conversion circuit 321.

In detail, the controller 310 may turn on the first and second semiconductor switches 323 and 324 connected to the battery circuit 322 and turn off the third semiconductor switch 325 connected to the driver 330.

When the first and second semiconductor switches 323 and 324 are turned on and the third semiconductor switch 325 is turned off, current Is1 output from the power conversion circuit 321 is supplied to the battery circuit 322 as shown in FIG. 12.

When the first semiconductor switch 323 includes a first MOSFET 323*a* and a first body diode 323*b* and the second semiconductor switch 324 includes a second MOSFET 324*a* and a second body diode 324*b*, the first MOSFET 323*a* may be turned off and the second MOSFET 324*a* may be turned on. Current Is1 output from the power conversion circuit 321 may be supplied to the battery circuit 322 via the first body diode 323*b* and the second MOSFET 324*a* as shown in FIG. 13 even when the first MOSFET 323*a* is turned off.

When it is determined in operation 1050 that an external power source is not connected (No in operation 1050), the vacuum cleaner 300 maintains a standby state (1070).

The controller 310 of the vacuum cleaner 300 does not supply DC power to the driver 330 or charge the battery circuit 322.

Specifically, the controller 310 may turn off the first and second semiconductor switches 323 and 324 connected to the battery circuit 322 and the third semiconductor switch 325 connected to the driver 330.

When the first, second, and third semiconductor switches 323, 324, and 325 are turned on, the driver 330 is not driven, and the battery circuit 322 is not charged.

As described above, the vacuum cleaner may supply the driving power to the driver from the external power source, supply the charging power to the internal power source from the external power source, or supply the driving power to the driver from the internal power source, depending on whether a cleaning operation is performed or whether the external power source is connected.

The invention claimed is:

1. A vacuum cleaner comprising:

a fan motor configured to generate suction;

an input button configured to receive an input of a user;

a first power supply circuit configured to convert alternating current (AC) power supplied from an external power source and output first direct current (DC) power;

a second power supply circuit configured to store electric energy upon receiving the first DC power, and output second DC power from the stored electric energy;

a driver circuit configured to drive the fan motor upon receiving at least one of the first DC power and the second DC power;

a first semiconductor switching circuit configured to control the first DC power that is supplied to the second power supply circuit;

a second semiconductor switching circuit configured to control the first DC power and the second DC power that are supplied to the driver circuit; and a microprocessor configured to output a control signal for turning on or off the first semiconductor switching circuit and the second semiconductor switching circuit, depending on the user input and a connection state of the external power source.

2. The vacuum cleaner of claim 1, wherein the first power supply circuit is connected to the driver circuit through a first current path, and the second power supply circuit is connected to a first node provided on the first current path through a second current path.

3. The vacuum cleaner of claim 2, wherein the first semiconductor switching circuit is installed on the second current path, and the second semiconductor switching circuit is installed on the first current path between the first node and the driver circuit.

4. The vacuum cleaner of claim 1, wherein the first semiconductor switching circuit includes a first semiconductor switch and a second semiconductor switch connected in series to the first semiconductor switch.

5. The vacuum cleaner of claim 4, wherein the first semiconductor switch includes a first Metal-Oxide-Semiconductor Field Effect Transistor (MOSFET) and a first body diode connected in parallel to the first MOSFET, the second semiconductor switch includes a second MOSFET and a second body diode connected in parallel to the second MOSFET, and a cathode terminal of the first body diode is connected to a cathode terminal of the second body diode.

6. The vacuum cleaner of claim 5, further comprising a gate driver configured to output driving signals to gate terminals of the first and second MOSFETS according to the control signal of the microprocessor.

7. The vacuum cleaner of claim 6, wherein each of the first MOSFET and the second MOSFET is a P-type MOSFET, wherein the gate driver includes:

a first step-down circuit configured to decrease a voltage of a node to which the first MOSFET and the second MOSFET are connected, and output the decreased voltage to the gate terminal of the first MOSFET; and a second step-down circuit configured to decrease a voltage of the node to which the first MOSFET and the second MOSFET are connected, and output the decreased voltage to the gate terminal of the second MOSFET.

8. The vacuum cleaner of claim 7, wherein the first step-down circuit includes a first voltage divider configured to divide a voltage of the node to which the first MOSFET and the second MOSFET are connected, and output the divided voltage to the gate terminal of the first MOSFET, and the second step-down circuit includes a second voltage divider configured to divide a voltage of the node to which the first MOSFET and the second MOSFET are connected, and output the divided voltage to the gate terminal of the second MOSFET.

9. The vacuum cleaner of claim 6, wherein each of the first MOSFET and the second MOSFET is a N-type MOSFET, wherein the gate driver includes:

a first step-up circuit configured to increase a voltage of the first DC power and the second DC power, and output the increased voltage to the gate terminal of the first MOSFET; and a second step-up circuit configured to increase a voltage of the first DC power and the second DC power, and output the increased voltage to the gate terminal of the second MOSFET.

10. The vacuum cleaner of claim 6, wherein the first MOSFET is a N-type MOSFET, and the second MOSFET is a P-type MOSFET, and the gate driver includes:

a first step-up circuit configured to increase a voltage of the first DC power and the second DC power, and output the increased voltage to the gate terminal of the first MOSFET; and a second step-down circuit configured to decrease a voltage of a node to which the first MOSFET and the second MOSFET are connected, and output the decreased voltage to the gate terminal of the second MOSFET.

11. The vacuum cleaner of claim 6, wherein the first MOSFET is a P-type MOSFET, and the second MOSFET is a N-type MOSFET, and the gate driver includes:

a first step-down circuit configured to decrease a voltage of a node to which the first MOSFET and the second MOSFET are connected, and output the decreased voltage to the gate terminal of the first MOSFET; and a second step-up circuit configured to increase a voltage of the first DC power and the second DC power, and output the increased voltage to the gate terminal of the second MOSFET.

12. The vacuum cleaner of claim 1, wherein in response to an operation command being received from the user and the external power source being connected, the microprocessor turns off the first semiconductor switching circuit and turns on the second semiconductor switching circuit.

13. The vacuum cleaner of claim 1, wherein in response to an operation command being received from the user and no external power source being connected, the microprocessor turns on the first semiconductor switching circuit and the second semiconductor switching circuit.

14. The vacuum cleaner of claim 1, wherein in response to no operation command being received from the user and the external power source being connected, the microprocessor turns on the first semiconductor switching circuit and turns off the second semiconductor switching circuit.

15. A method of controlling a vacuum cleaner including a fan motor, a driver circuit configured to drive the fan motor, a first power supplier for converting external power and a second power supplier for storing power supplied from the first power supplier, the method comprising:

providing DC power output from the first power supplier to the driver circuit by controlling a semiconductor switching circuit disposed among the driver circuit, the first power supplier and a second power supplier in response to an operation command being received from a user and an external power source being connected;

providing DC power output from the second power supplier to the driver circuit by controlling a second semiconductor switching circuit in response to an operation command being received from a user and no external power source being connected; and providing DC power output from the first power supplier to the second power supplier by controlling the semiconductor switching circuit in response to no operation command being received from a user and the external power source being connected.

* * * * *